US010738757B2

(12) United States Patent
Rannow et al.

(10) Patent No.: US 10,738,757 B2
(45) Date of Patent: Aug. 11, 2020

(54) VARIABLE DISPLACEMENT PUMP-MOTOR

(71) Applicant: Regents of the University of Minnesota, Minneapolis, MN (US)

(72) Inventors: Michael Rannow, Minneapolis, MN (US); Perry Yan-Ho Li, Plymouth, MN (US); Thomas Chase, Minneapolis, MN (US)

(73) Assignee: Regetns of the University of Minnesota, Minneapolis, MN (US)

( * ) Notice: Subject to any disclaimer, the term of this patent is extended or adjusted under 35 U.S.C. 154(b) by 779 days.

(21) Appl. No.: 15/368,643

(22) Filed: Dec. 4, 2016

(65) Prior Publication Data

US 2017/0159641 A1 Jun. 8, 2017

Related U.S. Application Data

(60) Provisional application No. 62/263,338, filed on Dec. 4, 2015.

(51) Int. Cl.
*F03C 1/40* (2006.01)
*F04B 1/143* (2020.01)
(Continued)

(52) U.S. Cl.
CPC ..... *F03C 1/0681* (2013.01); *F03C 1/0613* (2013.01); *F03C 1/0615* (2013.01);
(Continued)

(58) Field of Classification Search
CPC .... F03C 1/0681; F03C 1/0615; F03C 1/0626; F03C 1/0628; F03C 1/0631; F03C 1/0613;
(Continued)

(56) References Cited

U.S. PATENT DOCUMENTS 2,160,978 A * 6/1939 Mock ..... F02M 41/08 417/269
2,762,305 A * 9/1956 Huber ..... F04B 49/007 417/286
(Continued)

FOREIGN PATENT DOCUMENTS

EP 0361927 4/1990
GB 1119959 * 7/1968

OTHER PUBLICATIONS

"Piston-by-piston Control of Pumps and Motors using Mechinical Methods", Center for Compact and Efficient Fluid Power, [online]. [retrieved on Dec. 4, 2014]. Retrieved from the Internet: http://www.ccefp.org/research/thrust-1-efficiency/project-1e4, (2014), 2 pgs.
(Continued)

*Primary Examiner* — Charles G Freay
(74) *Attorney, Agent, or Firm* — Schwegman Lundberg & Woessner, P.A.

(57) ABSTRACT

A variable displacement pump-motor includes a pump-motor having a plurality of cylinders and pistons, and further including a main shaft rotatable relative to the system body. A hydro mechanical control system includes a plurality of main stage valves in communication with the plurality of cylinders. Each of the main stage valves is configured to open and close a cylinder of the plurality of cylinders to one or more of high or low pressure fluid sources. A pilot spool valve is in selective communication with each of the main stage valves. The pilot spool rotates with the main shaft. The pilot spool includes coding configured to operate each of the main stage valves to open and close the respective cylinders to the one or more high and low pressure fluid sources according to a translational position of the pilot spool and rotation of the pilot spool by the main shaft.

27 Claims, 13 Drawing Sheets

(51) Int. Cl.

| | |
|---|---|
| ***F04B 1/145*** | (2020.01) |
| ***F04B 1/146*** | (2020.01) |
| ***F04B 1/16*** | (2006.01) |
| ***F04B 53/10*** | (2006.01) |
| ***F03C 1/32*** | (2006.01) |
| ***F03C 1/06*** | (2006.01) |
| ***F04B 1/28*** | (2006.01) |
| ***F04B 7/00*** | (2006.01) |
| ***F03C 1/34*** | (2006.01) |

(52) U.S. Cl.
CPC ..... *F03C 1/0626* (2013.01); *F03C 1/0628* (2013.01); *F03C 1/0631* (2013.01); *F04B 1/143* (2013.01); *F04B 1/145* (2013.01); *F04B 1/146* (2013.01); *F04B 1/16* (2013.01); *F04B 1/28* (2013.01); *F04B 7/008* (2013.01); *F04B 53/10* (2013.01)

(58) Field of Classification Search
CPC ..... F04B 7/008; F04B 1/143; F04B 1/145; F04B 1/16; F04B 1/28; F04B 1/146; F04B 49/002; F04B 49/225
USPC ..... 417/237, 297.5; 91/476
See application file for complete search history.

(56) References Cited

U.S. PATENT DOCUMENTS 4,041,843 A * 8/1977 Mischenko ..... B30B 15/24 91/499
5,362,208 A * 11/1994 Inagaki ..... F04B 27/1018 417/222.2
5,366,202 A * 11/1994 Lunzman ..... F15B 13/0402 137/625.64
5,839,885 A * 11/1998 Oda ..... F04B 49/002 417/213
6,122,914 A * 9/2000 Hayashi ..... F16H 39/14 60/489
8,192,175 B2 6/2012 Kuttler et al.
8,197,224 B2 6/2012 Kuttler et al.
8,348,627 B2 1/2013 Rampen et al.
2008/0083894 A1* 4/2008 Li ..... F04B 49/24 251/129.05
2012/0141303 A1* 6/2012 Caldwell ..... F04B 1/0452 417/270

OTHER PUBLICATIONS

Rannow, Michael, "Optimal Design of a High-Speed On/Off Valve for a Hydraulic Hybrid Vehicle Application", 7th International Fluid Power Conference, (2010), 1-14.
Rannow, Mike, "Project 1E.4—Mechnanical Piston-by-Piston Control of a Pump/Motor", Center for Compact and Efficient Fluid Power, CCEFP Annual Meeting, (Sep. 2012), 14 pgs.
Tu, Hank C., "Design, Modeling, and Validation of a High-Speed Rotary Pulse-Width-Modulation On/Off Hydraulic Valve", J. Dyn. Sys.; Meas., Control 134(6); 061002, (Nov. 2012), 13 pgs.
Van De Ven, James D., "Phase-Shift High-Speed Valve for Switch-Mode Control", J. Dyn. Sys., Meas., Control 133 (1), 011003, (2010), 11 pgs.

* cited by examiner

VARIABLE DISPLACEMENT PUMP-MOTOR

CLAIM OF PRIORITY

This patent application claims the benefit of priority of Rannow et al., U.S. Provisional Patent Application Ser. No. 62/263,338, entitled "VARIABLE DISPLACEMENT PUMP-MOTOR," filed on Dec. 4, 2015, which is hereby incorporated by reference herein in its entirety.

STATEMENT REGARDING FEDERALLY SPONSORED RESEARCH OR DEVELOPMENT

This invention was made with government support under EEC-0540834 awarded by the National Science Foundation. The government has certain rights in the invention.

TECHNICAL FIELD

This document pertains generally, but not by way of limitation, to hydrodynamic pumps and motors.

BACKGROUND

Variable displacement pumps, motors and pump-motors provide one or more of variation in flow and torque and hence, power, by changing the displacement of fluid within the pump, motor or pump-motor. A pump-motor refers to a fluidic machine that can operate as a pump or as a motor. In some examples, variable displacement pumps and motors and pump-motors include axial piston pumps and motors and pump-motors including a plurality of pistons slidably received in a corresponding plurality of cylinders. The plurality of pistons are coupled with an adjustable swash plate. As the angle of the swash plate is changed (e.g., from a measure of 0 degrees to 1 or more degrees) the pistons correspondingly increase their stroke and thereby displace larger volumes of fluid. In the case of a pump, the larger displacement moves a larger volume of fluid to the fluid system, which means that greater fluid flow and power is transferred from the prime mover into the fluid system. In the case of a motor, the larger displacement generates greater torque and transfers a greater amount of power from the fluid system into the rotating shaft and in the process utilizes more fluid from the fluid system. Each of the pistons are exposed to high pressure during the high pressure portions of the respective pumping and motoring strokes of the pistons even if the strokes (and corresponding displacements) are relatively small.

In other examples, variable displacement pumps and motors use one or more electrically operated and controlled stage valves for each piston and cylinder to control the opening of the cylinders to high pressure fluid over a variable portion of the piston stroke of each of the plurality of pistons. For instance, pairs of electrically operated check valves are used as the main stage valves or operate the main stage valves according to a displacement algorithm included in a logic controller for the pump or motor. The logic controller operates each of the electrically operated check valves in correspondence with portions of the piston strokes to realize a specified displacement and corresponding pump or motor performance.

OVERVIEW

The present inventors have recognized, among other things, that a problem to be solved can include decreasing friction and leakage losses to increase pumping and motoring efficiency while also minimizing the number of valves, complex algorithms and electrical valve control for controlling the flow of high pressure fluid to and from a pump or motor or pump-motor (as used in discussion of the disclosure herein pump-motor is inclusive of pumps, motors and pump-motor systems). Variable displacement pumps and motors having adjustable swash plates expose each of the pistons and cylinders to high pressure fluids throughout the pumping stroke when high pressure fluid is pushed out, or the motoring stroke when high pressure fluid is taken in. Each stroke corresponds to half the pump or motor cycle. While the stroke lengths of the pistons decrease at lower displacements, the piston and cylinders are still exposed to high pressure fluid for half a cycle. Accordingly, even at low displacements, friction and leakage are ongoing issues and negatively affect pump and motor performance (e.g., efficiency, power, flow rate or the like). Further, electrical valve control with one or more main stage valves (e.g., check valves, spool valves and poppet valves) operated according to algorithms uses complex control logic to adjust valve opening and closing to provide specified combinations of displacement, flow rate and power. Complex control schemes and the corresponding valves and instrumentation for the valves add significant cost and complexity to pumps and motors.

The present subject matter can help provide a solution to this problem, such as by a variable displacement pump-motor system including a hydromechanical fluid control system. The hydromechanical fluid control system includes a pilot spool valve in selective communication with a plurality of main stage valves. The main stage valves open and close the cylinders (e.g., to a high pressure environment or to a low pressure environment) of the pump-motor system based on rotation and translation of the pilot spool valve. In one example, the pilot spool includes coding that varies (e.g., in one non-limiting example as a helix) based on the translational location of the pilot spool relative to pilot connection ducts. The helical coding controls the operation of the main stage valves and correspondingly controls the opening of the cylinders to high pressure fluid or low pressure fluid as the pilot spool rotates. Further, in one example the pilot spool is rotationally locked to the main shaft of the pump-motor system and accordingly the piston stroke timing corresponds with the helical coding of the pilot spool. In another example, the pilot spool and the main shaft are selectively locked or rotated relatively to each other, for instance with a planetary gear assembly, to adjust the timing between rotation of the main shaft and the pilot spool (e.g., with differing operating pressure, main shaft rotation speed, fluid compressibility or combinations of the same). In yet another example, the pilot spool and the main spool are locked during motoring and during pumping, but during the transition between motoring and pumping, a small offset is introduced with a backlash.

Because the pilot spool is annular and rotated to control the operation of the main stage valves the coding on the spool is in one example hi-directional. Accordingly, rotation of the pilot spool in opposed directions is conducted in some examples (along with corresponding opposed rotation of the main shaft and other components). With the pilot spool described herein having annular coding "4 quadrant" operation is achieved including operation of the pump-motor is both directions and pumping and motoring in each direction.

The displacement of the pump-motor system is varied with the hydromechanical fluid control system by translational positioning of the pilot spool. The translational position of the pilot spool controls the operation of the main stages and accordingly controls the duration of the opening of the cylinder to high pressure fluid (hence the displacement). By adjusting the translational position of the pilot spool, the displacement of the pump-motor system is thereby changed. The pistons maintain a full stroke length, and are only exposed to the high pressure fluid according to the translational position of the pilot spool (e.g., of the helical coding) and rotation of the pilot spool. Friction and leakage because of high pressure fluid are minimized with decreased displacement and closing of the cylinders to the high pressure fluid. Further, the hydromechanical fluid control system uses helical coding (e.g., recesses, deadbands and the like) formed in the pilot spool to mechanically and fluidically control the operation of the main stage valves and the corresponding displacement of the pump-motor system.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
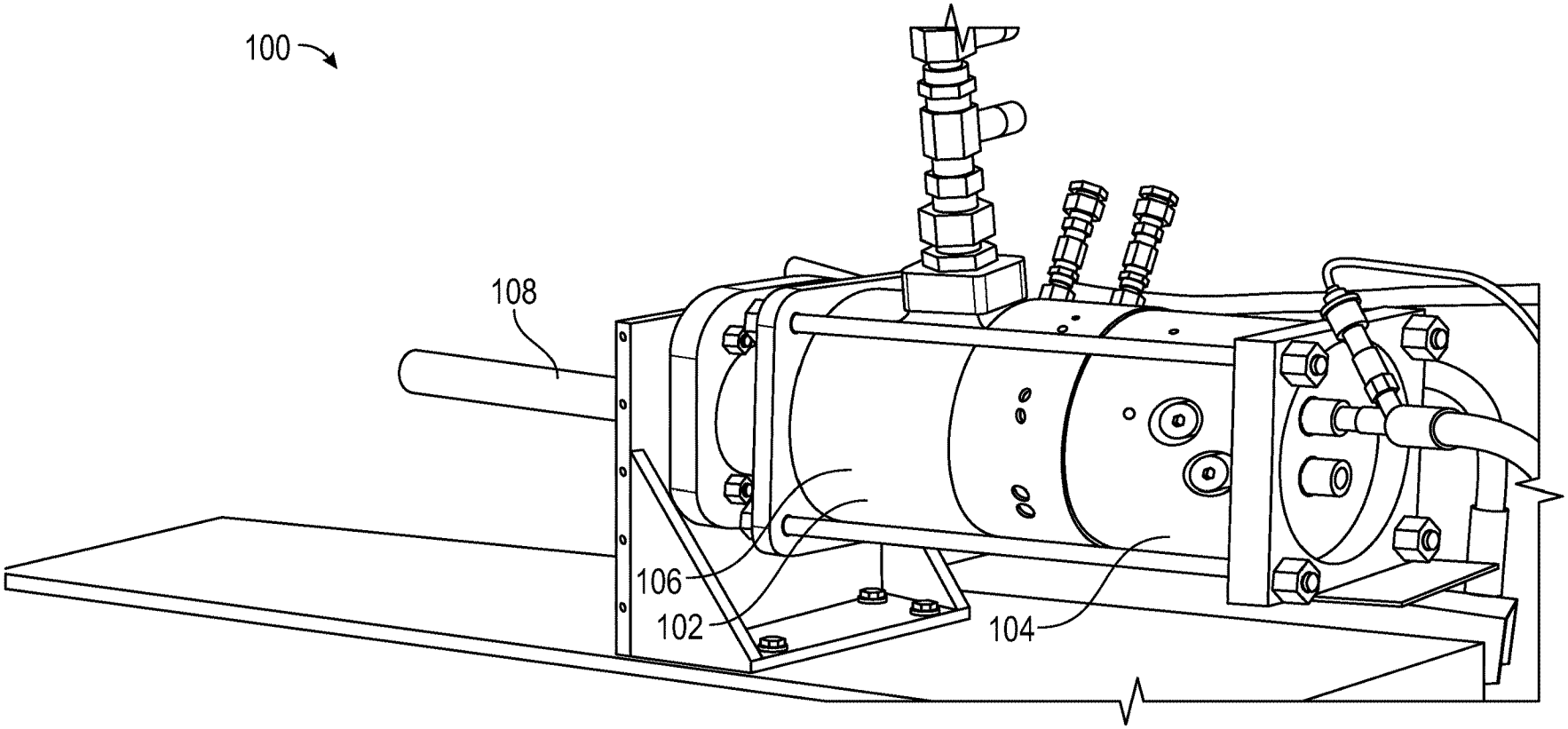
FIG. 1 is a perspective view of one example of a variable displacement pump-motor system.

FIG. 1 shows one example of a pump-motor system 100. As shown, the pump-motor system 100 includes a pump-motor 102 coupled with a hydro mechanical control system 104. In examples described herein, the hydro mechanical control system 104 is described alternately as a hydro mechanical fluid control system, control system or the like. As will be described herein, the hydro mechanical control system 104 cooperates with the pump-motor 102 to regulate or control the duty cycle of the pump-motor 102 including the closing or opening of one or more cylinders of the pump-motor 102 to one or more of a high pressure fluid or a low pressure fluid. As described herein, duty cycle refers to the fraction of the working stroke of the piston that includes opening of the respective cylinder to a high pressure fluid (e.g., system, such as a hydraulic system or the like). For example, in pumping mode, a duty cycle of 0.5 means that high pressure is applied to the piston for half of its travel upwards from bottom dead center to top dead center. Accordingly, by increasing or the decreasing the duty cycle the output of the pump-motor 102 (e.g., flow rate) is correspondingly increased or decreased. Similarly, where the pump-motor 102 is operated in a motoring configuration increasing or decreasing the duty cycle of the one or more pistons correspondingly increases or decreases the pump-motor 102 power output.

As further shown in FIG. 1, the pump-motor system 100 in an example includes a main shaft 108. In one example, the main shaft 108 is used as an input shaft, for instance, where the pump-motor 102 is operated as a pump. In another example, the main shaft 108 is an output shaft, for instance transmitting rotation generated by the pump-motor 102 when operated as a motor. The pump-motor 102 and optionally the hydro mechanical control system 104 are, in one example, housed within the system body 106. As shown in FIG. 1, the system body 106 is a unitary body surrounding the components of the pump-motor 102 and the hydro mechanical control system 104. In another example, the system body 106 is a multi-component housing for instance multiple housings for each of the pump-motor 102 and the hydro mechanical control system 104.

In the examples described herein, the pump-motor 102 is operated as one or more of a pump or motor. When referring to the pump-motor 102 the pump-motor is intended to describe a system operating solely as a pump, for instance, configured to operate solely as a pump, a motor system, for instance, a system configured to operate solely as a motor, or a combination system, for instance, a system configured to transition between and operate in pump and motor configurations.

Figure 2:
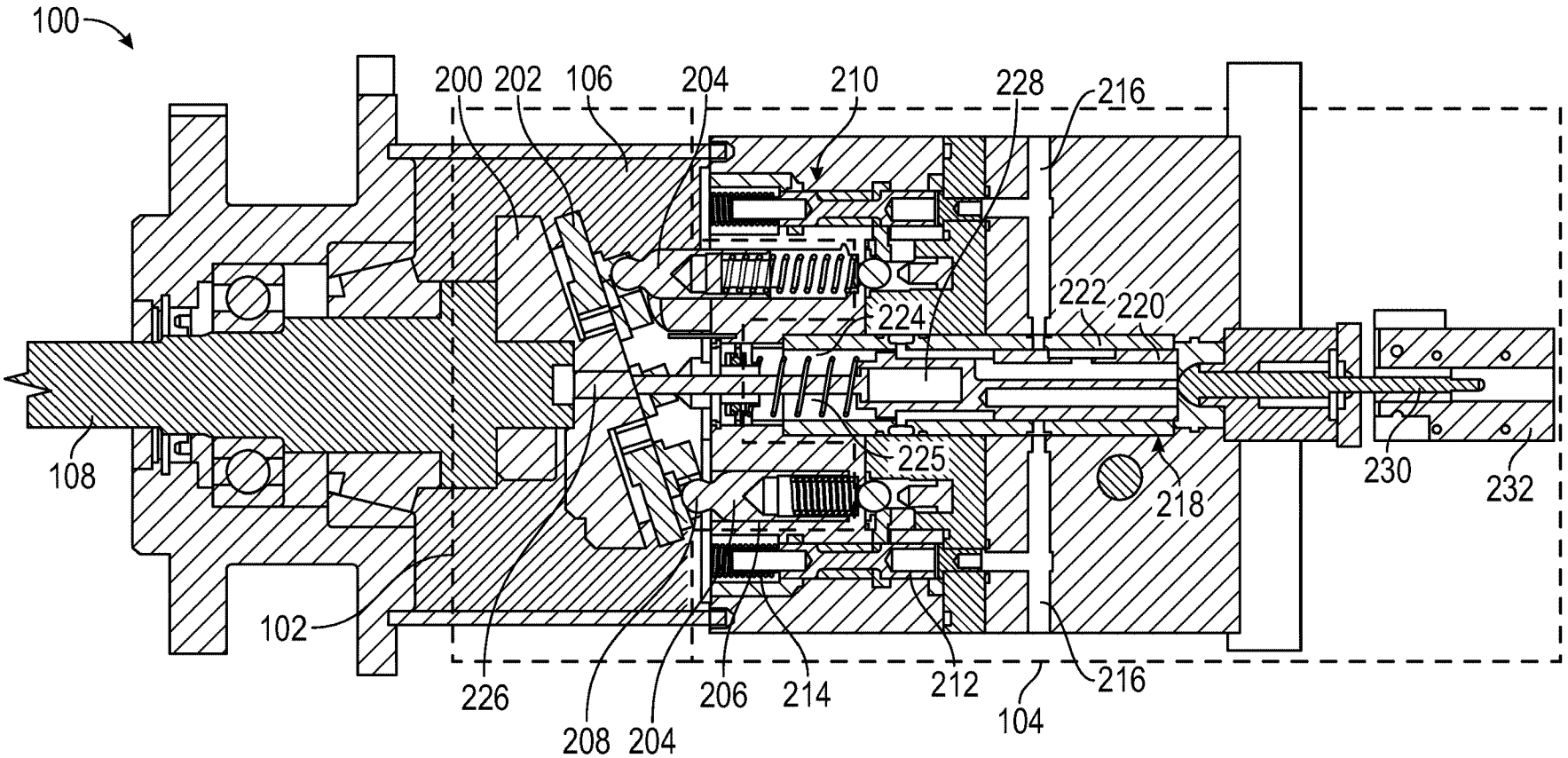
FIG. 2 is a cross sectional view of the variable displacement pump-motor system of FIG. 1.

FIG. 2 is a cross sectional view of the pump-motor system 100 previously shown and described with regard to FIG. 1.

As shown, the pump-motor system 100 includes the pump-motor 102 coupled with the hydro mechanical control system 104. Referring first to the pump-motor 102, the main shaft 108 is shown coupled with a wobble plate 200. In one example, the wobble plate 200 includes a fixed angle, for instance, an angle corresponding to an angle of the shoe plate 202. Rotation of the main shaft 108 where the pump-motor system 100 is operated as a pump correspondingly rotates the wobble plate 200. Conversely, where the pump-motor system 100 is operated as a motor rotation of the wobble plate 200 is transmitted to the main shaft 108. As further shown in FIG. 2, the wobble plate 200 is rotatably coupled with a shoe plate 202. The shoe plate 202 is nominally rotationally fixed relative to the system body 106 (and the cylinders 206 and pistons 204). As shown the shoe plate 202 includes a plurality of piston joints 208 coupled with pistons 204 of associated cylinders 206. In one example, as the wobble plate 200 rotates, for instance relative to the system body 106, the angled shape of the wobble plate 200 correspondingly engages against the shoe plate 202 and causes the shoe plate 202 to tilt relative to the position shown in FIG. 2 and accordingly reciprocate the pistons 204 relative to the cylinders 206. When the pump-motor system 100 is operated as a motor, reciprocation of the pistons 204 within the cylinders 206 rotates the wobble plate 200 and accordingly rotates the main shaft 108 to provide a power output from the pump-motor system 100. In another example, where the pump-motor system 100 is operated as a pump rotational energy input through the main shaft 108 correspondingly rotates the wobble plate 200 and thereby tilts the shoe plate 202 to reciprocate the pistons 204 within the cylinders 206. Reciprocation of the pistons 204 within the cylinders 206 accordingly pumps fluid from the pump-motor system 100.

In the example shown in FIG. 2, the translation of the pistons 204 relative to the cylinders 206 is set. For instance the wobble plate 200 and correspondingly the shoe plate 202 have a set angle relative to the system body 106. Accordingly the reciprocation of the pistons 204 within their respective cylinders 206 remains consistent throughout operation of the pump-motor system 100. In the examples described herein the pump-motor system 100 will be described with regard to the wobble plate 200 and the shoe plate 202 (e.g., having a fixed angle and accordingly a consistent piston stroke within the cylinders 206). In other examples however the pump-motor system 100 includes swash plates or other adjustable features or the like to accordingly change the piston stroke of the piston 204 relative to the cylinder 206.

It should be noted that the present disclosure is not restricted to wobble plate type pumps or motors. This disclosure is also applied to other designs with hydraulic pistons (e.g., radial piston pumps-motors that use a cam-follower mechanism, or linkage pump-motors that use a mechanical linkage). Further, the present disclosure is also applicable with other pump-motor configurations including, but not limited to, a cam in a radial piston pump-motor configuration or a crank-shaft configuration. Further still, in other examples the wobble plate 200 includes another type of plate, for instance a swash plate configured to change angle relative to the system body 106 and accordingly change the displacement to one or more pistons 204 relative to the cylinders 206.

Referring again to FIG. 2, the hydro mechanical control system 104 (outlined with broken lines) is shown coupled with the pump-motor 102 (also separately outlined with broken lines). As shown in the cross section provided in FIG. 2 the hydro mechanical control system 104 includes a plurality of main stage valves 210 associated with each of the respective pistons 204 and cylinders 206. As will be described herein the main stage valves 210 selectively open and close each of the cylinders 206 to a high pressure environment and to the low pressure environment. For instance, where the pump-motor system 100 is operated as a motor the main stage valves 210 facilitate the input of high pressure fluid to the cylinders 206 for corresponding translation of the pistons 204 (between top dead center and bottom dead center) to rotate the main shaft 108. When the pump-motor system 100 is operated as a pump the main stage valves 210 selectively open and close the cylinders 206 to a low pressure environment (e.g., sump, low pressure fluid reservoir or the like) to draw fluid into the pump-motor 102 for pumping (e.g., the pistons moving between bottom dead center to top dead center) into a high pressure system or environment.

As shown in FIG. 2 the example main stage valves 210 include a valve operator 212 that is moveable relative to the system body 106. In one example the valve operator 212 is translated to the left or right according to the desired operation of the main stage valve 210 and corresponding selective opening and closing of the cylinder 206 to high and low pressure systems (e.g., pressurized circuits such as hydraulics, sumps or the like). As will be described herein one or more pressures are applied to the valve operator 212 (directly or indirectly with the plunger 312) of the main stage valves 210 to facilitate movement of the valve operators 212 to open and close the cylinders 206. The timing and length of time of opening and closing (as well as transition through a deadband in some examples) of the main stage valves 210 is controlled by a pilot spool valve 218 also shown in FIG. 2. By the selective application of fluids under different pressures the valve operator 212 of each of the main stage valves 210 are moved to the left and right to accordingly open (and close) each of the cylinders 206 to high and low pressure fluids. In one example each of the main stage valves 210 include one or more valve biasing elements 214 configured to bias the valve operators 212 of each of the main stage valves 210 to an initial position. For instance, the valve operator 212 is biased in one example toward an initial position shown in FIG. 2 with the valve operator 212 seated to the right within a cavity of the respective main stage valve 210.

FIG. 2 shows one example with the main stage valves 210 including a translationally movable valve operator 212 provided within corresponding cavities for each of the main stage valves 210. In other examples the main stage valves 210 include other valve operators for instance poppets or the like configured to operate with the pilot spool valve 218 to selectively open and close the cylinders 206 to high and low pressure fluids.

A pilot spool 220 of the pilot spool valve 218 shown in FIG. 2 is in one example coupled with the main shaft 108 for instance with an interface shaft 226 extending from the main shaft 108 to a translation cavity 228 of the pilot spool 220 of the pilot spool valve 218. In one example the interface shaft 226 and the interior wall of the translation cavity 228 rotationally lock the pilot spool 220 relative to the main shaft 108 and accordingly rotation of the main shaft 108 (and corresponding staged reciprocation of the pistons 204 relative to the cylinders 206) is matched to the rotation of the pilot spool 220. In some examples, the interface shaft 226 and the translation cavity 228 allow for some backlash, for instance a limited degree of relative rotation of the pilot spool 220 relative to the main shaft 108. Optionally, this limited backlash of the otherwise rotationally locked pilot spool 220 facilitates the transition of operation of the pump-motor 102 and the pilot spool valve 218 between the pumping and motoring configurations. Further, and as described herein (see FIGS. 11 and 12), the main shaft 108 and the pilot spool 220 are in one example coupled together with interposed planetary or differential gear sets to offset the rotation between the main shaft and the pilot spool.

The pilot spool valve 218 as shown includes the translation cavity 228 as previously described herein. The pilot spool 220 is accordingly configured to translationally move within a valve sleeve 222 of the pilot spool valve 218 relative to the sleeve 222 and the interface shaft 226 (while the spool 220 is rotationally locked with the interface shaft 226). As will be described herein translation of the pilot spool 220 moves coding provided along the pilot spool 220 relative to one or more pilot connection ducts 216 to accordingly vary the operation of the main stage valves 210 and the corresponding opening and closing of the cylinders 206 to high and low pressure fluids. In one example the pilot spool valve 218 is coupled with or includes a spool translation drive 232. The spool translation drive 232 (e.g., a mechanical actuator, solenoid, electric, pneumatic, or hydraulic operated actuator or the like) is coupled with a spool plunger 230 that is engaged with at least a portion of the pilot spool 220. Movement of the spool plunger 230 accordingly moves the pilot spool 220 within the valve sleeve 222 and positions the coding of the pilot spool 220 relative to the pilot connection ducts 216 to control the operation of the main stage valves 210 including controlling (e.g., regulating, maintaining, changing or the like) the opening and closing of the cylinders 206 to high and low pressure fluids (and in some examples controlling the dead-band of each of the valves 210 as described herein). Accordingly translation of the pilot spool 220 relative to the pilot connection ducts 216 is used in cooperation with rotation of the pilot spool 220 to vary the opening and closing of the cylinders 206 to high and low pressure fluids (e.g., control the duty cycle of each of the pistons 204 and cylinders 206). Variation of the duty cycle varies the opening of the cylinders 206 to the high pressure fluid and controls each of power output (for a motor) and flow output (for a pump). By controlling the communication of the cylinders 206 to the high pressure fluid the output of the pump-motor 102 is controlled while efficiency is increased (and leaks, friction and the like are minimized).

In the example shown in FIG. 2 the pilot spool 220 is positioned within a spool cavity 224 of the valve sleeve 222 (optionally a component of the system body 106). The pilot spool 220 is as previously described in one example moved by a spool plunger 230. Optionally the spool cavity 224 includes a spool biasing element 225 (e.g., provided at an opposed end of the pilot spool 220 relative to the spool plunger 230) to translate the pilot spool 220 in a reverse manner relative to movement of the spool plunger 230. In the example shown in FIG. 2 for instance the spool plunger 230 is configured to bias the pilot spool 220 from the right to the left while the spool biasing element 225 is configured to bias the pilot spool 220 from the left to the right. In another example the pilot spool 220 is biased by a single mechanism, for instance the spool translation drive 232 and corresponding spool plunger 230 engaged with the pilot spool 220 in a fixed manner. For instance the spool plunger 230 is rotatable relative to the pilot spool 220 but translationally fixed to the pilot spool 220 to facilitate the reciprocating movement of the pilot spool 220 within the spool cavity 224 of the valve sleeve 222. In such an example, the spool plunger 230 is configured to move the pilot spool 220 to the left and right within the spool cavity 224 without otherwise interfering with rotation of the pilot spool 220 for instance for operation of the one or more main stage valves 210.

Figure 3A:
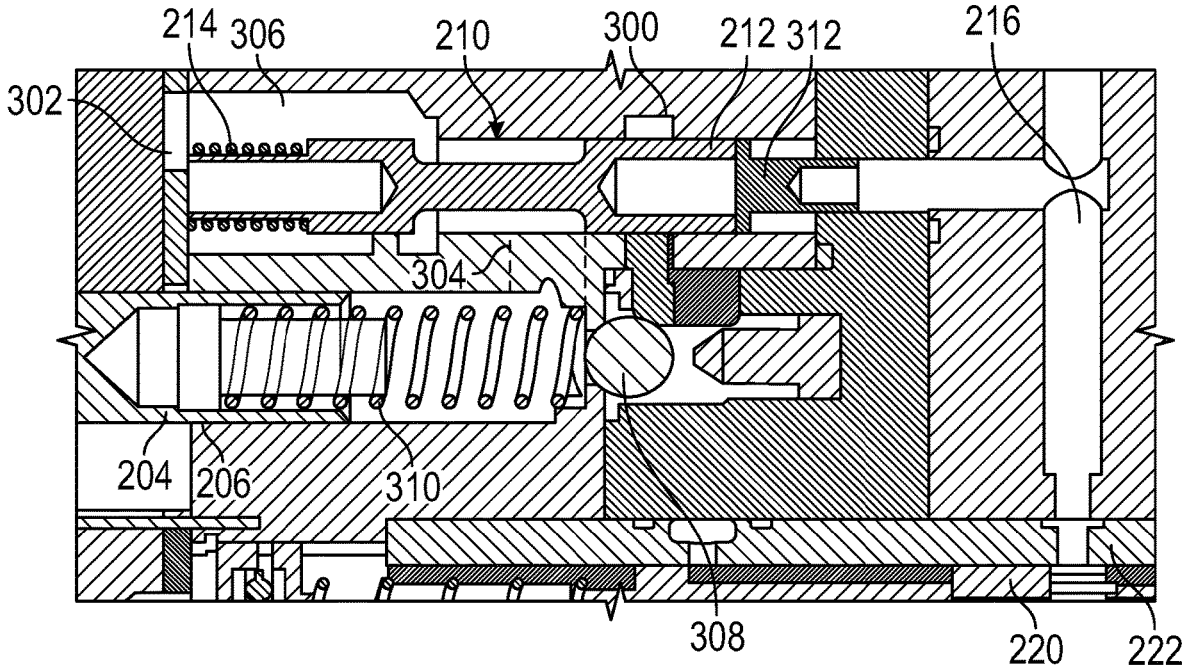
FIG. 3A is a first cross sectional view of a cylinder and piston with an associated main stage valve.
Figure 3B:
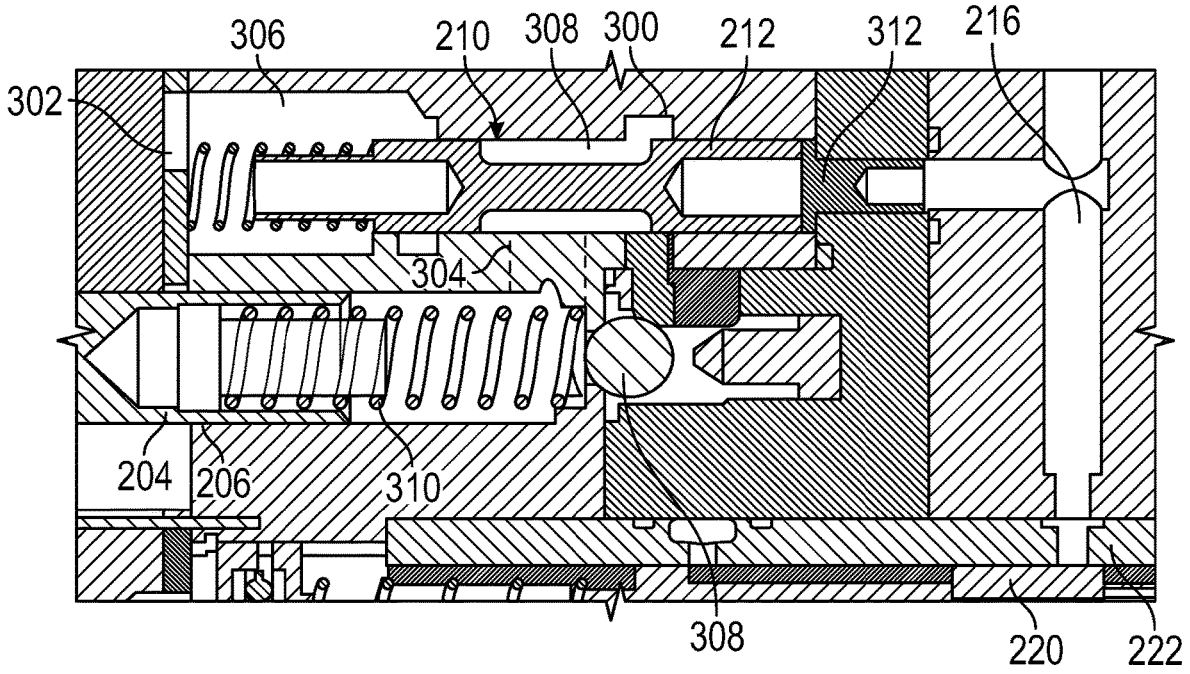
FIG. 3B is a second cross sectional view of the cylinder and piston of FIG. 3A with the associated main stage valve.

FIGS. 3A and 3B show the main stage valve 210 in two example configurations including a first configuration shown in FIG. 3A with the cylinder 206 closed to a high pressure fluid source (e.g., through a high pressure port 300) and open to a low pressure fluid (e.g., through a low pressure port 302). FIG. 3B conversely shows the main stage valve 210 in a second configuration with the high pressure fluid at the high pressure port 300 in communication with the cylinder 206 and the cylinder 206 closed to the low pressure fluid (e.g., at the low pressure port 302).

Referring first to FIG. 3A, the main stage valve 210 including for instance the valve operator 212 is shown in a first (closed) configuration relative to the second (open) configuration shown in FIG. 3B (open and closed being relative to the high pressure fluid communicated with the pistons and cylinders). As shown the valve operator 212 is in one example biased by a plunger 312 to overcome a bias provided by a valve biasing element 214 provided at an opposed end of the valve operator 212.

As will be described herein the pilot spool 220 includes coding configured to variably supply relatively low and high pressure fluids (e.g., fluid at tank pressure and fluid at a pilot pressure greater than the low pressure fluid, such as 50, 100 or 150 psi greater or the like) through the pilot connection ducts 216 to each of the main stage valves 210. For instance the application of a low (or tank) pressure fluid through the pilot connection duct 216 does not overcome the bias provided by the valve biasing element 214 and the valve operator 212 is accordingly biased into the second (open) configuration shown in FIG. 3B. As shown in FIG. 3A, the plunger at 312 is exposed to a higher pressure fluid, for instance a pilot pressure fluid at a relatively higher pressure compared to the tank pressure fluid. The application of the low (tank) pressure fluid or the high (pilot) pressure fluid is controlled by the pilot spool 220 and its corresponding coding. As shown in FIG. 3A the plunger 312 is biased by the applied pilot pressure fluid and accordingly moves the valve operator 212 from the right to the left to thereby close the cylinder 206 to the high pressure fluid delivered through the high pressure port 300. Optionally, the high pressure port 300 is an annular port extending around a portion of the of the valve operator 212. While the valve 210 closes the cylinder 206 to the high pressure port it opens the cylinder 206 to the low pressure port 302 (through a cylinder port 304). For instance in one example fluid at a low pressure (e.g., from a tank, sump, reservoir or the like) is delivered through the low pressure port 302 and drawn into the cylinder 206 for instance by movement of the piston 204 between top dead center and bottom dead center. In another example, the low pressure port 302 is an annular port extending around a portion of the valve operator 212.

It is further shown in FIG. 3A the cylinder 206 in one example includes a piston biasing element 310 configured to bias the piston 204 toward a bottom dead center position. In other examples the piston biasing element 310 is not included and accordingly movement of the piston 204 is governed by operation of an attached plate, such as the shoe plate 202 and wobble plate 200 (shown in FIG. 2). In another example the cylinder 206 includes a check valve 308 for instance provided at the end of cylinder 206 to facilitate pressure equalization within the cylinder 206 (and optionally used in combination with other features described herein, such as the deadband of the main stage valve 210, to optimize the pre-compression and decompression within the respective cylinder 206). As described herein, in at least some examples multiple check valves, including high and low pressure check valves 900, 902 (see FIGS. 9 and 10), are used in combination with the deadband of the main stage valve 210 to optimize pre-compression and decompression.

Referring now to FIG. 3B, the main stage valve 210 is shown in the converse configuration to that shown in FIG. 3A. For instance, the valve operator 212 is shown positioned to the right (relative to FIG. 3A) with the plunger 312 recessed (also relative to FIG. 3A). In this configuration the high pressure port 300 is in communication with the cylinder 206 by way of the cylinder port 304. The cylinder 206 is open to high pressure fluid from the port 300, for instance where the pump-motor 102 is operated as a motor to accordingly move the piston 204 between top dead center and bottom dead center. Conversely, where the pump-motor 102 is operated as a pump opening of the cylinder 206 to the high pressure system facilitates the pumping of fluid from the cylinder 206 (with movement of the piston 204 between bottom dead center and top dead center) through the high pressure port 300.

In operation, the pilot spool 220 (partially shown in FIGS. 3A, B and shown in FIG. 2) including the coding provided thereon is rotated to selectively apply low (tank) and relatively higher (e.g., pilot) pressure fluids through the pilot connection duct 216 to the main stage valves 210. Application of low and higher pressure fluid transitions the valves 210 between the configurations shown in FIGS. 3A and 3B. As described herein, the pilot pressure fluid selectively applied by the pilot spool 220 is relatively higher than the low pressure fluid applied by the pilot spool (e.g., around 100 psi greater) and in some examples relatively less than the high pressure fluid supplied through the high pressure port 300 (e.g., hundreds to thousands psi) and used for pumping or motoring as described herein. In an example, including a pilot pressure fluid having a higher pressured than the low pressure fluid and lower than the high pressure fluid supplied to the pump-motor 102 minimizes leaking at each of the main stage valves 210 and the pilot spool valve 218 as each of these valves are at least partially isolated (and the pilot spool valve 218 is entirely isolated) from the high pressure fluid used in pumping or motoring. Accordingly, seals, fittings and tolerances are correspondingly sized and configured to minimize friction, increase responsiveness and at the same time minimize leaking and increase efficiency. Optionally, the high pressure fluid communicated from the pilot spool 220 is in an example at the same pressure (and may be the same fluid) as the high pressure fluid used in the cylinders 206.

Figure 4:
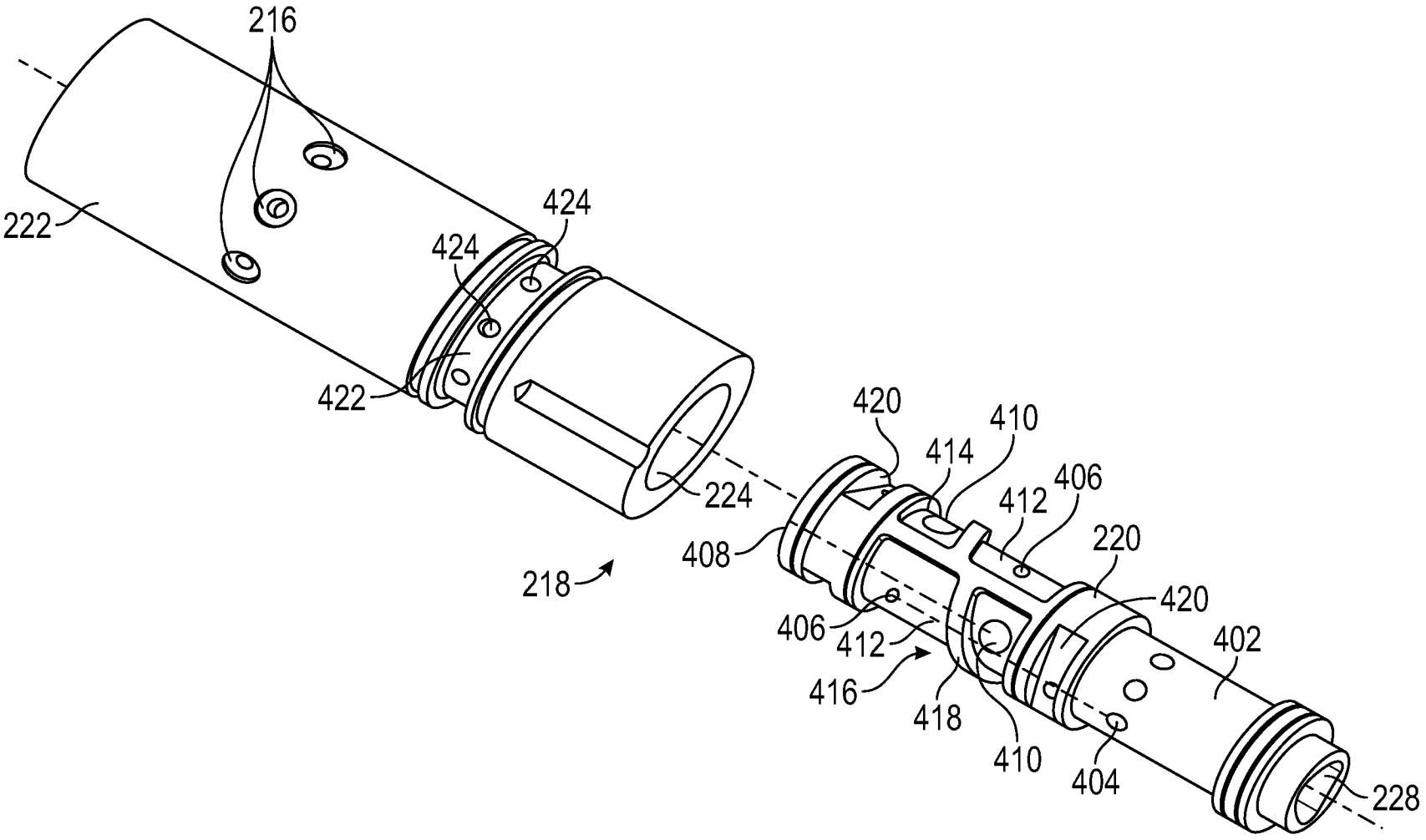
FIG. 4 is an exploded view of one example of a pilot spool valve including a pilot spool and a valve sleeve.

FIG. 4 shows an exploded view of the pilot spool valve 218 previously shown in FIG. 2. In the exploded view provided in FIG. 4 the valve sleeve 222 is spaced from the pilot spool 220. Referring first to the valve sleeve 222 (optionally a portion of the system body 106) includes a plurality of pilot connection ducts 216. Further, as shown the valve sleeve 222 includes one or more manifold ports 424 configured to deliver a pressurized fluid such as a pilot (relatively high) pressure fluid to one or more regions of the pilot spool 220 as described herein. In the example shown in FIG. 4 the valve sleeve 222 includes a manifold groove 422 that distributes pilot pressure fluid to each of the manifold ports 424 around the valve sleeve 222 to ensure the supply of pilot pressure fluid to the corresponding pilot inlet recess 402 (e.g., a fluid annular inlet port) shown along the pilot spool 220.

The valve sleeve 222 includes a spool cavity 224 configured to receive the pilot spool 220 therein. As previously described, the pilot spool 220 is slidable within the valve sleeve 222 to control the operation of the main stage valves 210 and thereby control (e.g., regulate, control, change or the like) the opening and closing of the cylinders such as the cylinders 206 shown in FIG. 2 to each of high and low pressure fluids as described herein.

Referring again to the pilot spool 220, the spool includes a translation cavity 228 sized and shaped to receive the interface shaft 226 shown in FIG. 2. In the example shown in FIG. 4 the translation cavity 228 has a noncircular configuration sized and shaped to receive a corresponding noncircular portion of the interface shaft 226 to facilitate the transmission of rotation between the main shaft 108 and the pilot spool 220. As further shown in FIG. 4, the pilot spool 220 includes a pilot inlet recess 402 configured for communication with the manifold ports 424 of the valve sleeve 222. The pilot inlet recess 402 extends along a portion of the pilot spool 220 to ensure continued communication between the manifold ports 424 and the pilot spool 220 during translation of the pilot spool 222 within for the spool cavity 224. As further shown the pilot inlet recess 402 (e.g., a fluid annular inlet port provided around the spool 222) includes a plurality of pilot inlet ports 404 in communication with corresponding pilot outlet ports 406 provided in corresponding high pressure (pilot) regions 412, such as recesses, provided around the pilot spool 220 (the connections between the pilot inlet ports 404 and pilot outlet ports 406 are shown with dashed lines in FIG. 4).

As further shown in FIG. 4 the pilot spool 220 includes a low (tank) pressure fluid inlet 408 (e.g., a fluid axial inlet port). The low pressure fluid inlet 408 communicates with one or more low pressure (tank) regions 414, such as recesses, for instance by way of low pressure fluid outlet ports 410. In the example shown in FIG. 4 the low pressure fluid inlet 408 is provided at an end of the pilot spool 220 opposed to the translation cavity 228. Fluid provided at low pressure is delivered through the low pressure fluid inlet 408 for instance through one or more passages formed in the pilot spool 220 (and shown in dashed lines) to the low pressure fluid outlet ports 410 provided in each of the corresponding low pressure regions 414.

The combination of the low (tank) pressure regions 414, relatively high (pilot) pressure regions 412 as well as a tapered profile 418 (e.g., an angled ridge or the like) in one example provides coding 416 for the pilot spool 220. As previously described herein the coding 416 of the pilot spool 220 regulates the flow of pressurized fluids to each of the main stage valves 210 and the corresponding opening and closing of the associated cylinders to high and low pressure fluids. In one example, the selective application of relatively higher pressure fluid, such as pilot pressure fluid (e.g., greater than low pressure) by way of the high pressure regions 412 to the main stage valves 210 biases the valve operators 212 (directly or indirectly with the plunger 312) into the configuration shown in FIG. 3A. Conversely, the application of low pressure fluid, such as a tank pressure fluid, through the pilot connection ducts 216, for instance from the low pressure regions 414 of the pilot spool 220, allow the valve operator 212 to assume the configuration shown in FIG. 3B corresponding to the opening of the associated cylinder 206 to the high pressure port 300 and a high pressure fluid.

Figure 5:
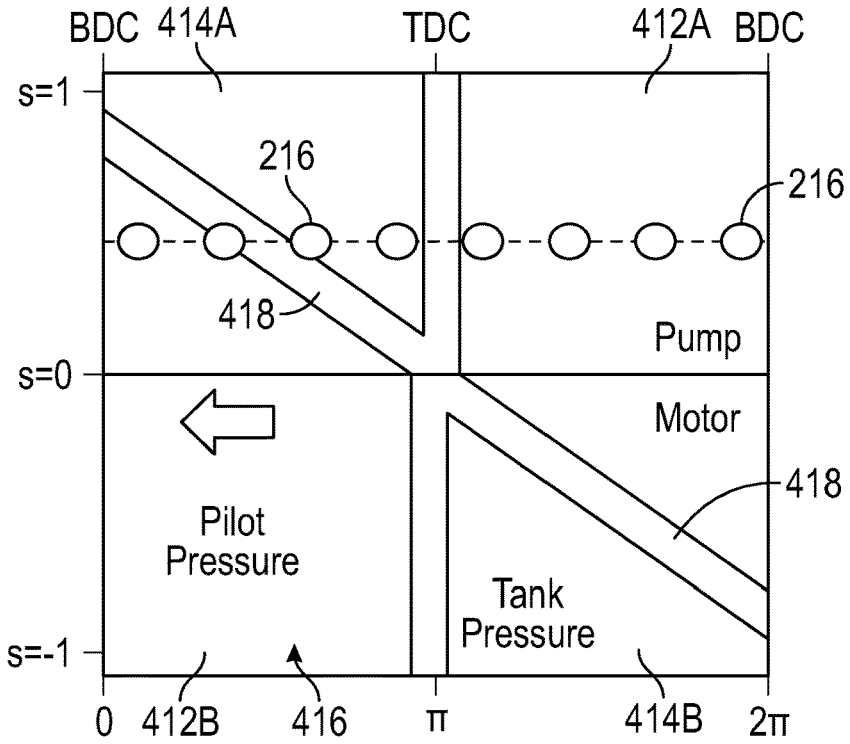
FIG. 5 is a schematic view of one example of coding for a pilot spool.
Figure 6:
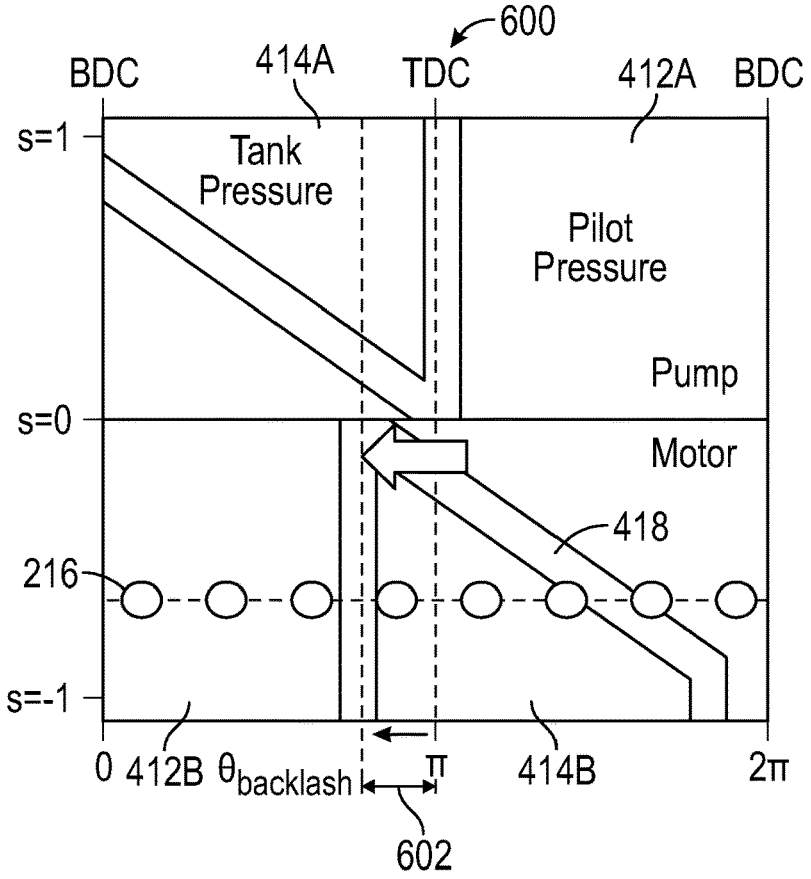
FIG. 6 is a schematic view of another example of coding for another pilot spool.

The example coding 416 shown in FIG. 4 provides a hydro mechanical form of control to each of the main stage valves 210 that controls the duty cycles of each of the associated pistons 204 and cylinders 206. For instance, the size and shape (a high pressure profile) of the high pressure regions 412 ("high pressure" being relative to the low pressure provided at the regions 414) and the size and shape (a low pressure profile) of the low pressure (tank) regions 414 as well as the position and shape of the tapered profile 418 control the duty cycle of each of the pistons 204 and cylinders 206 of the pump-motor 102. Further, with the inclusion of a nonlinear profile such as the tapered profile 418 shown in FIG. 4 and corresponding varied lengths (extending annularly around the spool) of the relatively high and low pressure regions 412, 414 changes in the duty cycle of each of the pistons 204 and cylinders 206 are realized, for instance with translation of the pilot spool 220 within the spool cavity 224. As shown in FIGS. 5 and 6 in one example the operation of the pump-motor 102 is controlled (e.g., regulated, changed or the like) by movement of the coding 416 relative to the pilot connection ducts 216. As shown the pilot connection ducts pass through each of the pilot (relatively high pressure) and low pressure regions 412, 414 for varying amounts of time according to the tapered profile 418 as well as the shape and size of each of the high (pilot) and low pressure regions 412, 414. The variations in the application of higher pressure (pilot) fluid and lower pressure (tank) fluid to each of the main stage valves 210 (directly or indirectly with the plunger 312) correspondingly open and close the associated cylinders 206 to one or more of a high pressure fluid or low pressure fluid (e.g., at the high pressure port 300 or the low pressure port 302 in FIGS. 3A, B) over the desired duty cycle of each of the pistons 204 and cylinders 206.

As further shown in FIG. 4, in at least one example the pilot spool 220 includes one or more balance notches 420 provided around the pilot spool 220. In one example the balance notches cooperate with the high pressure regions 412 to provide offsetting pressures around the pilot spool 220 to substantially prevent the binding or seizing of the pilot spool 220 within the valve sleeve 222. For instance in the example shown in FIG. 4 the balance notch 420 is staggered around the pilot spool 220 in an offset manner relative to the pilot pressure regions 412. Accordingly, as pilot pressure fluid is delivered from the pilot inlet ports 404 to each of the high pressure (pilot) regions 412 a small amount of the pilot pressure fluid is diverted to each of the balance notches 420 to sufficiently balance the pilot spool 220 within the valve sleeve 222 and thereby facilitate the continued rotation and translation of the pilot spool 220 relative to the remainder of the pump-motor 102 and the hydro mechanical control system 104, such as the valve sleeve 222.

FIGS. 5 and 6 show two examples of coding 416, 600 in an unwrapped configuration relative to the pilot spool 220 shown in FIG. 4. For instance, the respective high and low pressure regions are shown in an unwrapped configuration (relative to the annular configuration in FIG. 4) to facilitate their explanation. Referring first to FIG. 5, the coding 416 provided in FIG. 4 is shown. The high pressure (pilot) region 412 is shown in two components 412A and 412B corresponding respectively to pump operation and motor operation with the pump-motor 102 shown in FIG. 2 rotating in a first direction (corresponding to the unwrapped spool coding 416 moving from right to left in FIG. 5), and optionally in an opposed second direction (the spool coding moving left to right in FIG. 5). Further the coding 416 includes low pressure regions 414, such as a low pressure (tank) region 414A for pump operation and a low pressure region 414B for motor operation. As further shown in FIG. 5, a tapered profile 418 is provided between each of the respective high and low pressure regions 412A, 414A and 412B, 414B. The tapered profile 418 in combination with each of the respective regions (e.g., recesses provided along with the pilot spool 220) facilitates the control (including regulating, adjusting, changing or the like) of the main stage valves 210 for each of the associated cylinders 206 and pistons 204. For instance, as previously described herein, while the pilot connection ducts 216 are in communication with each of the respective regions 412, 414 the main stage valve 210 is correspondingly operated as one of the high pressure (pilot) fluid or low pressure (tank) fluid is applied to the main stage valve operator 212 (directly or indirectly with the plunger 312). As described herein the high pressure fluid used to set the position of the main stage valve is optionally a fluid pressurized just above the low pressure fluid, the high pressure fluid of the system or another pressurized fluid having a pressure greater than the low pressure fluid.

Furthermore, because the pilot spool 220 provides an annular and accordingly continuous control element for the main stage valves 210 that is paired with operation of the pistons 204 (e.g., by the interface shaft 226 and main shaft 108 shown by example in FIG. 2) the pilot spool 220 and the pump-motor 102 are operable bidirectionally, with selective rotation of the main shaft 108 and the pilot spool 220 in the first and second opposed directions. In addition, the example coding 416 in FIG. 5 is symmetric with respect to the diagonal from the bottom left to the top right. With rotation in either of the first and second directions the pump-motor 102 with the hydromechanical control system 104 described herein is configured to operate as one or both of a pump or motor.

As shown in FIG. 5, the low pressure region 414A in one example has a substantially triangular shape including at least one angled side formed by the tapered profile 418. As the pilot spool 220 rotates the low pressure region 414A moves across each of the respective pilot connection ducts 216 and accordingly delivers low pressure (tank) fluid to each of the respective main stage valves 210 (directly or indirectly with plunger 312). The application of low pressure fluid through the pilot connection ducts 216 maintains the valve operators 212 in an open configuration and thereby opens the associated cylinders 206 to the high pressure fluid through the high pressure port 300. Conversely, as the pilot spool 220 continues to rotate the coding 416 of the pilot spool 422 including the high pressure region 412A passes over the respective pilot connection ducts 216 and accordingly delivers high pressure (pilot) fluid to the respective main stage valves 210 (e.g., directly to the operators 212 or indirectly by way of the plungers 312) in communication with the high pressure region 412A. The associated valve operators 212 are moved into the configuration shown in FIG. 3A. In this configuration, the cylinder 206 is closed relative to the high pressure fluid and is open to a low pressure fluid, for instance provided through the low pressure port 302 in valve cavity 306 shown in FIG. 3A.

By axially translating the pilot spool 220 within the spool cavity 224 the coding 416, including the tapered profile 418 and the low pressure regions 414A, B and high pressure regions 412A, B for pumping and motoring, is moved relative to the pilot connection ducts 216. Referring to FIG. 5, the parameter "S" indicates the duty cycle for pistons coupled with the pilot spool 220 (e.g., by shafts, gears sets or the like as described herein). S=1 corresponds to a pumping configuration for the pump-motor 102 and the pistons 204 and the cylinders 206 are in communication (open) with the high pressure fluid of the system for the entire travel of the pistons between bottom dead center to top dead center. S=0 corresponds to the pistons 204 and the cylinders 206 in communication (open) with the low pressure fluid for the entire travel of the pistons 204 between top dead center and bottom dead center. And S=−1 corresponds to motoring and the cylinders 206 and pistons 204 in communication with high pressure fluid for the entire travel of the piston 204 from top dead center to bottom dead center. Accordingly, S=0.5 corresponds to pumping at a 50 percent duty cycle or displacement (e.g., the cylinder 206 is open to high pressure fluid from the time the piston 204 is at the halfway point between bottom dead center to top dead center until the piston 204 reaches top dead center. Accordingly, as the coding 416 is moved upwardly relative to the pilot connection ducts 216 for instance closer to S=0 the duty cycle for the pistons 204 and cylinders 206 decreases. That is to say the low pressure region 414A for pump operation becomes gradually smaller as the pilot connection ducts 216 are only within the low pressure region 414A for a limited time before entering the high pressure region 412A and thereby closing the main stage valves 210 and the respective cylinders 206 to the high pressure fluid. Conversely, as the coding 416 is moved downwardly the duty cycle of the associated cylinders 206 and pistons 204 is increased (e.g., toward a full duty cycle at S=1) according to the longer span of the low pressure region 414A and corresponding increase in the length of time the cylinder 206 is opened to the high pressure fluid during travel of the piston 204.

In another example, the pilot spool 220 is transitioned into a motoring configuration. The pilot spool 220 is moved relative to the pilot connection ducts 216 (upwardly in this example and with the pilot connection ducts below the s=0 line in the coding 412) to position the high and low pressure regions 412B, 414B in communication with the pilot connection ducts 216. As shown in FIG. 5, the shape and position of the low pressure regions 414A, 414B are inversed as are the high pressure regions 412A and 412B with regard to rotational position around the pilot spool 422 (e.g., between 0 and two pi). Accordingly, the pump-motor 102 when controlled by the example coding 416 in a motoring configuration with the regions 412B and 414B operates opposite relative to the pump and accordingly engages in power output (e.g., motoring).

By varying the axial position of the pilot spool 220 and rotating the pilot spool the coding 416 of the spool controls the opening and closing of the cylinders 206 and thereby controls the duty cycle of the pistons 204 and cylinders 206. As stated above, the varied high and low pressure regions (412A, B and 414A, B) and the tapered profile 418 provide one example of the coding 416 used to control (e.g., regulate, maintain, change or the like) the duty cycles of the cylinders 206 and the pistons 204. Furthermore, as previously described herein, the pump-motor 102 and the hydromechanical control system 104 are optionally operable in reverse (e.g., with rotation in a second opposed direction). When rotated in the opposed direction, the high and low pressure regions 412A, B and 414A, B of the pilot spool 220 are in effect reversed with the upper regions 412A, B acting to control the operation of the system 102 in a motoring configuration while the lower regions 414A, B control operation in a pumping configuration (along with adjusting duty cycles as described above).

FIG. 6 shows another example of coding 600 similar in at least some regards to the coding 416 shown in FIG. 5. The pump-motor, in this example, is assumed to be rotating in a first direction (corresponding to the unwrapped spool coding 600 moving from right to left). In the example shown in FIG. 6 at least the low pressure region 414B corresponding to motoring operation of the pump-motor 102 is shifted by a region shift 602 relative to the position shown in FIG. 5. The pilot valve spool coding 600 in FIG. 6 is modified relative to that shown in FIG. 5 to exploit the deadband of the main stage valve 210 for improving efficiency in motoring mode. The bottom portion (the portions below S=0) is offset from the top portion (the portion above S=0) by the region shift 602 (from right to left by an angle labeled $\theta_{backlash}$ in FIG. 6) to initialize pre-compression slightly before the piston 204 reaches top dead center. Accordingly, as the main-stage valve transitions through its deadband toward connection to high pressure, the remaining volume of fluid in the piston (closed to high and low pressure while the main stage valve 210 is in its deadband) is pre-compressed to a high pressure such that when the cylinder 206 is connected to high pressure, throttling losses are minimized (e.g., eliminated or minimized) and efficiency is increased. Accordingly, shifting the timing of the high pressure (e.g., pilot pressure) to low pressure (tank) transition (e.g., the high and low pressure regions 412B. 414B) as described herein moves the region the main stage valve 210 is transitioning and its deadband while motoring to occur at the tail end of the exhaust stroke of the piston (and before top dead center is reached). In one example, the timing adjustment (e.g., the example region shift 602) for pre-compression is used in motoring operation of the pump-motor 102 but is optionally not used for decompression during pumping operation since the latter occurs at the beginning of the intake stroke.

When the pump-motor 102 rotates in the opposite second direction the upper portion of the coding in FIG. 6 is the motoring portion and the lower portion is for pumping. The region shift 602 should then be applied to the top (motoring) portion in the opposite (to the right) direction. Accordingly, the fixed profile in FIG. 6 with the shift 602 in what is the pumping region with opposite rotation will not achieve the desired pre-compression function. In another example if the amount of angle shift adjustment (e.g., the shift) is fixed and specified (e.g., a set amount quantity of angle shift adjustment), the adjustment (corresponding to the shift 602) is implemented with the profile in FIG. 5 by optionally adding a backlash between the main shaft 108 and the wobble plate 200 (in an example system using a wobble plate 200; as described herein other systems are used in other examples) or between the main shaft 108 and the pilot spool 220 (e.g., between the interface shaft 226 and the spool). In the example shown in FIG. 6, the direction of the torque will implement the region shift only when the pump-motor is motoring but not when it is pumping.

Figure 7A:
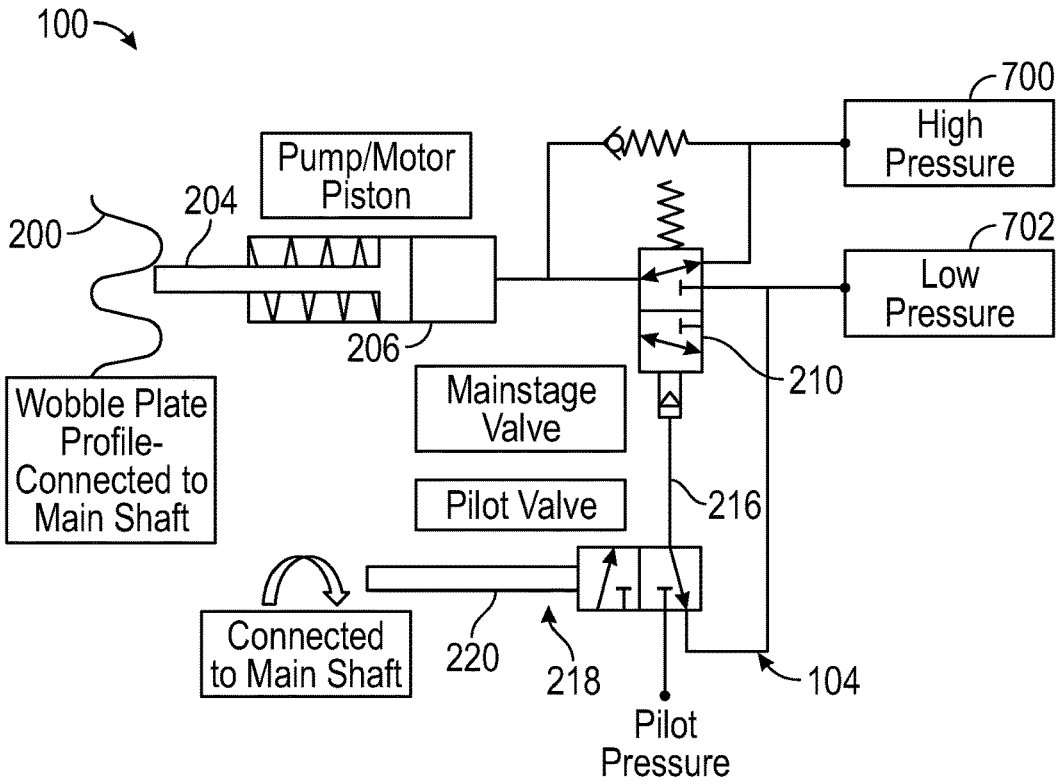
FIG. 7A is a schematic diagram of the system of FIG. 1 with the pilot spool and the main stage valve in example first positions.
Figure 7B:
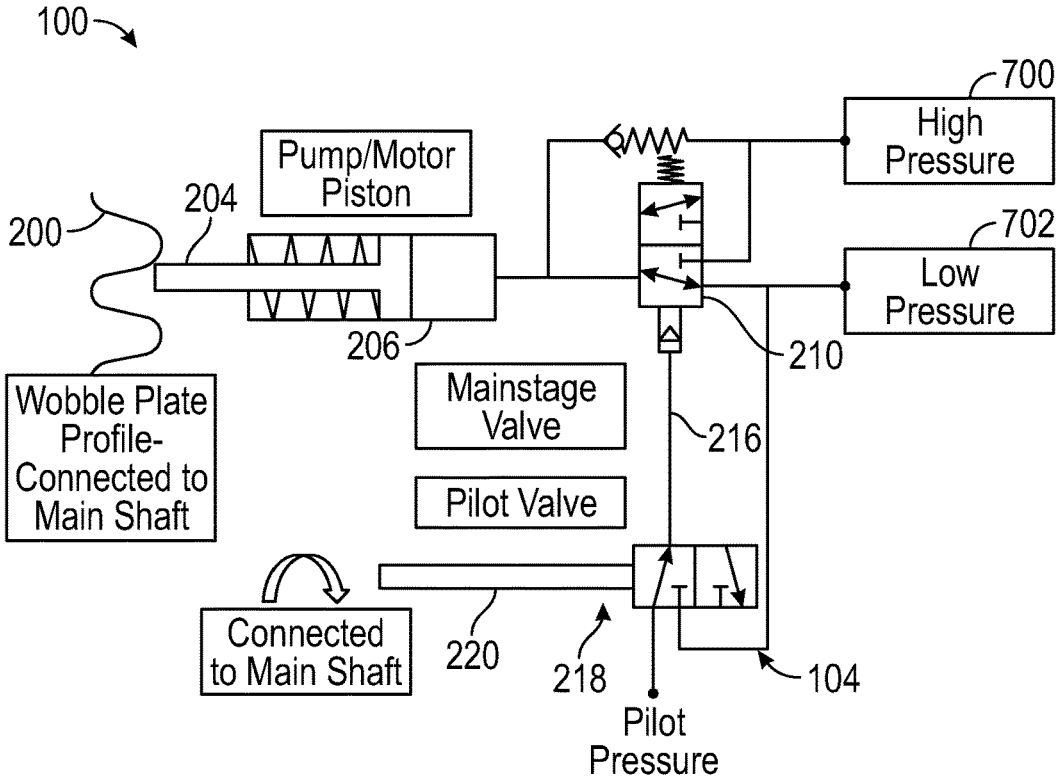
FIG. 7B is a schematic diagram of the system of FIG. 1 with the pilot spool and the main stage valve in example second positions.

FIGS. 7A and 7B show schematic diagrams of the pump-motor system 100. The pump-motor system 100 shown in the schematic diagrams includes a representative piston 204 and cylinder 206 and the associated control system, for instance components of the hydro mechanical control system 104 previously described herein. The control system 104 includes, but is not limited to, a main stage valve 210, a pilot spool valve 218 in communication with the main stage valve 210 and one or more fluid connections such as the pilot connection duct 216 and the like. As further shown in FIGS. 7A and 7B the pump-motor system 100 in an example includes a high pressure fluid source 700 and a low pressure fluid source 702. In one example the high pressure fluid source includes a fluid maintained at pressures including, but not limited to, 300 to 5,000 psi. Conversely, the low pressure fluid source provides low pressure fluid at a pressure of 0 to 100 psi or the like. In one example the low pressure fluid source 702 includes, but is not limited to, an oil sump, tank, reservoir or the like configured to maintain a volume of oil at atmospheric pressure. Further, in this example, the pilot pressure fluid (corresponding to the high pressure fluid for the pilot spool valve 218 and communicated to operate the main stage valve 210) has a higher pressure than the low pressure fluid (e.g., around 50, 100, 150, 200, 250, 300 psi or more relative to the low pressure fluid) and has a significantly lower pressure than the high pressure fluid of the system communicated to the cylinder 206 and the piston 204, shown with the high pressure fluid source 700. In another example, the pilot pressure fluid shown in FIGS. 7A, B is identical to the high pressure fluid used with the system, for instance that shown at the high pressure fluid source 700.

Referring first to FIG. 7A, the hydro mechanical control system 104 is shown in a configuration with the cylinder 206 opened to the high pressure fluid from the high pressure fluid source 700. As shown the pilot spool valve 218 including the pilot spool 220 is in a configuration with the pilot connection duct 216 in communication with a low pressure (tank pressure) portion of the coding 416. For instance referring again to FIG. 5, in one example the pilot spool 220 includes coding 416 and one or more of its low pressure regions 414A, 414B overly the pilot connection duct 216 shown in in FIG. 7A. The main stage valve 210 is accordingly in an open configuration and thereby provides communication between the high pressure fluid source 700 and the cylinder 206 (see the example arrangement provided in FIG. 3B as well).

In a pumping example the pilot spool 220 positions the low pressure region 414A in alignment with the pilot connection duct 216 (see FIG. 5) and the cylinder 206 is open to the high pressure fluid source 700. Rotation from the wobble plate 200 (FIG. 2) moves the piston 204 toward top dead center and pumps the fluid in the cylinder into a system including the high pressure fluid source 700. Conversely, in the motoring configuration, the pilot spool 220 positions the low pressure region 414B of the motor region of the coding 416 (see FIG. 5) over the pilot connection duct 216. The main stage valve 210 opens the cylinder 206 to the high pressure fluid for instance at or near top dead center to facilitate the filling of the cylinder 206. The piston 204 is moved toward bottom dead center by the high pressure fluid and the translation of the piston 204 is converted to rotation to the wobble plate 200 thereby outputting power from the pump-motor 102 for instance through the main shaft 108 shown for instance in FIG. 1 and FIG. 2.

FIG. 7B shows the pump-motor system 100 in the converse orientation, for instance where the pilot spool 220 of the pilot spool valve 218 has one of the high pressure regions 412A for pumping operation or 412B for motoring operation overlying the pilot connection duct 216. In this example pilot pressure is applied to the main stage valve 210 (directly or indirectly with the plunger 312). In one example the pilot pressure fluid includes a pressurized fluid having a pressure greater than that of the low pressure fluid 702. For instance, the pilot pressure fluid is provided at 100 psi (substantially lower than the high pressure fluid 700) to facilitate operation of the main stage valve 210. The application of the pilot pressure fluid to plunger 312 biases the valve operator 212 into the configuration shown in FIG. 3A. For instance the pilot pressure fluid applied through the duct 216 moves the plunger 312 from the right to the left and accordingly biases the valve operator 212 shown in FIG. 3A against the valve biasing element 214. With the main stage valve in the configuration shown in FIG. 3A and schematically shown in FIG. 7B, the cylinder 206 is closed relative to the high pressure source 700. Instead, the cylinder 206 is open to the low pressure fluid source 702.

In a pumping configuration opening of the cylinder 206 to the lower pressure fluid source facilitates the drawing of low pressure fluid into the cylinder 206 and the evacuation of low pressure fluid out of the cylinder 206 during a portion of the pumping stroke to reduce the pumping duty cycle. Conversely opening the cylinder 206 during motoring to the low pressure fluid source 702 facilitates the evacuation of the cylinder 206 and resets the piston 204 near top dead center for opening to the high pressure fluid source 700. Opening the cylinder 206 during motoring to the low pressure fluid source 702 is also used to draw low pressure fluid into the cylinder 206 during a portion of the motoring stroke to reduce the magnitude (e.g., time or length) of the motoring duty cycle. Referring to FIG. 5, the high pressure region as shown in one example for pumping is the high pressure (pilot pressure) region 412A and for motoring is the high pressure (pilot pressure) region 412B. The overlying of the pilot connection ducts 216 in either of the high (pilot) pressure regions 412A. 412B accordingly closes the main stage valve 210 in this example to the high pressure fluid source 700.

In another example the operation of the pump-motor system 100 is reversed. For instance, in one example pilot pressure is applied to the main stage valve 210 to accordingly move the stage valve operator into a configuration where the cylinder 206 is in communication ('on') relative to the high pressure fluid source 700. Conversely, the application of tank (low) pressure through the pilot spool valve 218 to the main stage valve 210 closes the cylinder 206 to the high pressure fluid 700 and opens the cylinder 206 to the low pressure fluid 702.

Figure 8:
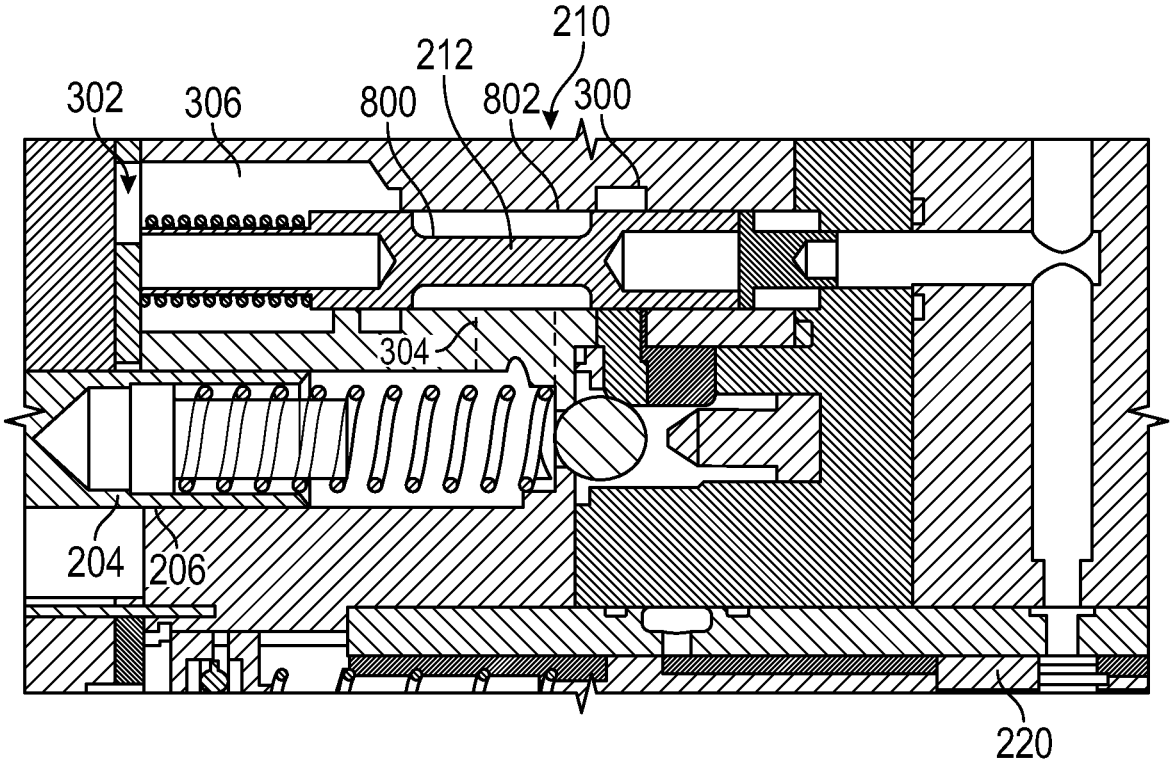
FIG. 8 is a third cross sectional view of the cylinder and piston of FIG. 3A with the main stage valve operator in a deadband region.

FIG. 8 shows a detailed view of the example main stage valve 210 and other components of the pump-motor 102 and the hydromechanical control system 104 in communication with or coupled to the valve 210. In the configuration shown the valve operator 212 is positioned at an intermediate position relative to the positions that open the cylinder 206 to the low pressure port 302 and the high pressure port 300 (and the corresponding low and high pressure fluids or systems). Positioning of the valve operator 212 in this position is referred to as the deadband for the main stage valve 210. In this configuration the cylinder 206 is closed relative to each of the low and high pressure fluids. In one example the piston 204 and the cylinder 206 continue to operate with reciprocation of the piston 204 relative to the cylinder 206 to accordingly pre-compress and decompress fluid within the cylinder 206 that is otherwise isolated from each of the high and low pressure ports 300, 302.

By closing the cylinder 206 pre-compression and decompression are controlled in a specified manner, for instance to minimize throttling losses while at the same time increasing the recovery of energy from the compressed fluid in the cylinder 206. In one example, by pre-compressing a fluid with the piston 204 prior to opening of the cylinder 206 to the high pressure port 300 and the high pressure fluid provided therein throttling losses otherwise caused by a pressure differential between the cylinder 206 and the high pressure fluid are avoided. In a second example, decompression is accomplished with the piston 204 by reciprocating the piston 204 toward its bottom dead center position prior to opening of the cylinder 206 to the low pressure fluid (e.g., through the low pressure port 302). By continuing the movement of the piston 204 toward bottom dead center while the main stage valve 210 is in the deadband region, energy contained in the compressed fluid is recovered and accordingly the system made more efficient prior to opening of the cylinder 206 to the low pressure fluid.

In the example shown in FIG. 8 the deadband of the main stage valve 210 is tuned or specified according to one or more of an operator deadband region 800 shown in FIG. 8 and a cavity deadband region 802 also shown in FIG. 8. By shrinking the operator deadband region 800 between the larger diameter portions of the valve operator 212 (e.g., increasing the length of the large diameter portions and decreasing the length of the short diameter portions) the overall deadband for the valve operator 212 within the valve cavity 306 is increased. Stated another way, each of the low and high pressure ports 300, 302 are isolated by the valve operator 212 over a longer period of time because of the increased length of the larger portion of the valve operators 212. Because of the increased length of the large diameter portions of the operator 212 the cylinder 206 is closed to both of the low and high pressure ports 300, 302 for a longer portion of the operator 212 travel. Conversely, by enlarging the cavity deadband region 802 (e.g., lengthening the space between the high pressure port 300 and that portion of the valve cavity 306 configured to receive low pressure fluid from the low pressure port 302) the deadband region for the main stage valve 210 is also increased. Stated another way, as the valve operator 212 moves between the high pressure port 300 and the portion of the valve cavity 306 in communication with the low pressure port 302 shown in FIG. 8 the main stage valve 210 is in the deadband as described herein. Increasing the space between the ports 302, 300 increases the overall travel needed by the valve operator 212 to open the cylinder 206 to each of the low and high pressure ports 302, 300. Accordingly, the overall deadband of the main stage valve 210 is increased as well. In still other examples one or more (e.g., both) of the operator deadband region 800 and the cavity deadband region 802 are increased or decreased for a specified combination of pump and motor operating parameters including, but not limited to, system pressure, main shaft speed, fluid compressibility for the fluid acted upon by the pistons 204 and cylinders 206 and the like to provide a corresponding specified combination of pre-compression and decompression for those operator parameters to increase one or more of power output, efficiency or the like.

Figure 9:
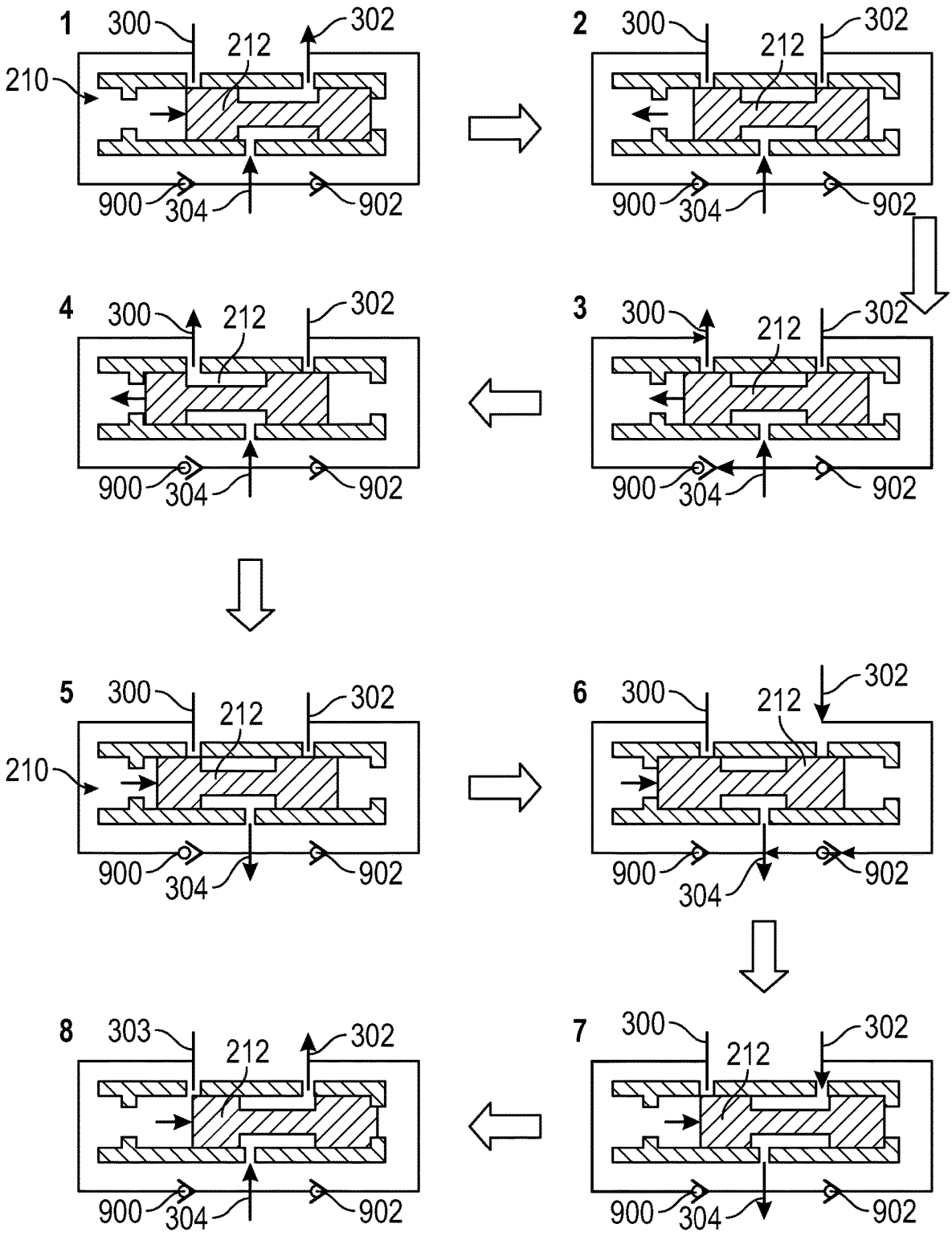
FIG. 9 is an array of schematic diagrams showing return and pump strokes with deadband and check valve controlled pre-compression and decompression in a cylinder and piston.
Figure 10:
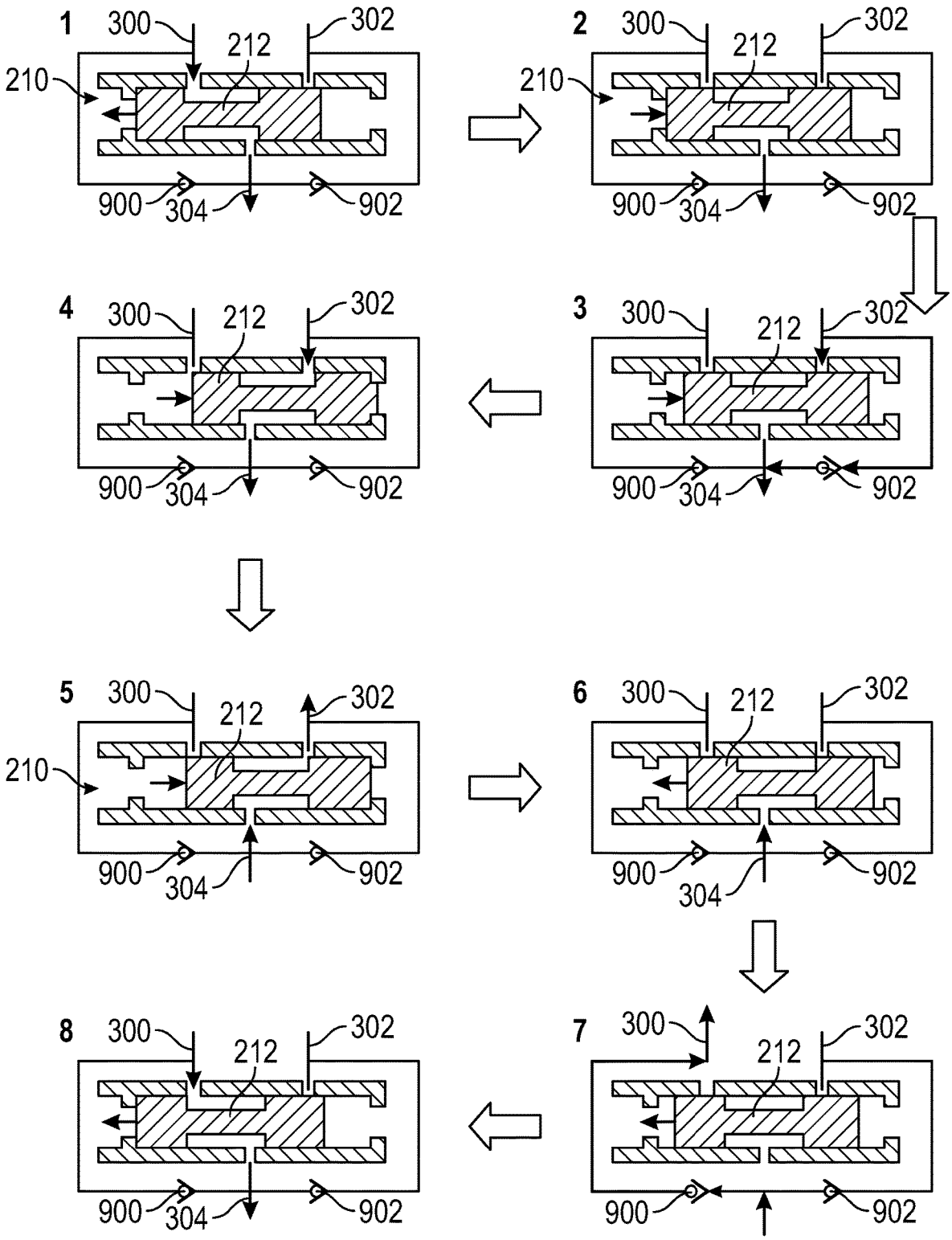
FIG. 10 is an array of schematic diagrams showing return and motor strokes with deadband and check valve controlled pre-compression and decompression in the cylinder and piston.

FIG. 9 shows a series of diagrams (1 through 8) illustrating the main stage valve 210 and its valve operator 212 in a variety of positions to facilitate pre-compression and decompression with the piston 204 and its associated cylinder 206 with the pump-motor 102 in pumping operation. FIG. 10 conversely shows the motoring operation with pre-compression and decompression. As shown in each of the diagrams provided in FIG. 9 the main stage valve 210 includes the valve operator 212 in a variety of positions relative to the high and low pressure ports 300, 302. As further shown in the diagrams the main stage valve 210 is in communication with the cylinder 206 by way of the cylinder port 304.

As further shown in the diagrams, in at least this example the main stage valve 210 (or the associated ducting around the valve) includes one or more check valves such as a high pressure check valve 900 (also shown as the check valve 308 in FIGS. 3A, B) and a low pressure check valve 902. The check valves 900, 902 are provided between the cylinder 206 (e.g., the cylinder port 304 shown in the diagrams) and the respective high and low pressure fluid sources such as the high pressure port 300 and the lower pressure port 302. As described herein, the high and low pressure check valves 900, 902 control pre-compression and decompression in the cylinders 206, for instance where the deadband of the respective main stage valve 210 is sufficiently long (in time) so either or both of pre-compression or decompression develop pressures that exceed the threshold pressure values to trigger opening of the respective check valves 900, 902. Accordingly, with the arrangement of high and low pressure check valves 900, 902 and the main stage valve 210 having a longer deadband duration (e.g., by way of dimensional changes as described above or throttling fluids from the pilot spool 220 described herein and shown in FIG. 15) optimized pre-compression and decompression are achieved so that the pressures in the cylinder 206 when opened to the high and low pressure fluid sources (e.g., sources 700, 702 in FIGS. 7A, B) substantially match. Throttling losses (otherwise caused with pressure differentials), power output and corresponding efficiency are thereby enhanced for the pump-motor 102 with these enhancements to the control system (e.g., the hydromechanical control system 104).

Diagram 1 of FIG. 9 shows the valve operator 212 in a first position corresponding to a near bottom dead center position for the piston 204 within the cylinder 206 with the pump-motor 102 in a pumping configuration. As shown the cylinder port 304 and accordingly the cylinder 206 are in communication with the low pressure port 302. When the pump-motor is in the pumping configuration and the duty cycle is less than one, valve operator 212 remains in the configuration shown in diagram 1 during a portion of the travel of piston 204 from bottom dead center to top dead center, enabling low pressure fluid to be exhausted through cylinder port 304 to low pressure port 302. As the valve operator 212 transitions to the deadband position shown for instance in diagram 2 the valve operator 212 is at a position between each of the high and low pressure ports 300, 302. The piston 204 within the cylinder 206 travels from bottom dead center toward top dead center and accordingly begins pre-compression of fluid within the cylinder 206 because the main stage valve 212 closes the cylinder 206 to each of the high pressure port 300 and the low pressure port 302. As further shown in diagram 3, the valve operator 212 is fully within the deadband region for the main stage valve 210. Accordingly, the piston 204 and cylinder 206 are isolated relative to each of the high and low pressure ports 300, 302 for the remainder of the travel of the valve operator 212 until it opens the cylinder 206 to the high pressure port 300. In this example the continued movement of the piston 204 within the cylinder 206 accordingly pre-compresses remaining fluid within the cylinder 206. Further, as shown in diagram 3 the high pressure check valve 900 opens as the pre-compressed fluid within the cylinder 206 reaches a threshold pressure, for instance corresponding to the pressure of the high pressure source of port 300 with bias provided by the high pressure check valve 900, to facilitate the passage of pressurized fluid from the cylinder 206 to the high pressure port 300 before the valve operator 212 moves out of the deadband. Since the bias provided by the high pressure check valve 900 is small, for example, 1 to 2 psi, throttling loss is minimal.

Referring now to diagram 4 of FIG. 9, the valve operator 212 continues to move in correspondence with the piston 204 (e.g., through interrelation of the main shaft 108, wobble plate 200 and the pilot spool 220 as described herein). In the example shown in diagram 4 the valve operator 212 has moved out of the deadband region and accordingly the cylinder 206 communicates with the high pressure port 300 by way of the cylinder port 304. In the example shown in diagram 4 because of the pre-compression (previously described with regard to diagrams 2 and 3) the pressure within the cylinder 206 substantially matches the pressure at the high pressure port 300 as the cylinder 206 is opened to the high pressure fluid. The pre-compressed fluid is immediately pumped from the cylinder 206 through the high pressure port 300. Throttling losses otherwise experienced across the main stage valve 212 because of pressure differentials without pre-compression are thereby avoided. Moreover, as pre-compression is ended by the high pressure check valve 900 when it opens, which coincides with the time that the pre-compression equals (with a small bias) the pressure at the high pressure port 300, this timing is not as sensitive to or dependent on the duration that the valve operator 212 is in the deadband, as long as the deadband duration is longer than the pre-compression time to ensure the high pressure check valve 900 controls the length of pre-compression.

Referring now to diagram 5 of FIG. 9, with the piston 204 having reached top dead center and beginning the return toward bottom dead center within the cylinder 206, the main stage valve 212 begins to move in a converse direction to that previously shown in diagrams 1, 2, 3 and 4. As shown in diagram 5 of FIG. 9 the valve operator 212 is moving from the left to the right. The main stage valve 210 transitions in this manner according to operation of the pilot spool 220 as described herein. As shown in diagram 5 the valve operator 212 moves into the deadband region between each of the high and low pressure ports 300, 302 and thereby isolates the cylinder 206 from each of the high and low pressure fluids. As the piston 204 continues to move toward bottom dead center from top dead center decompression within the cylinder 206 begins. As shown in diagram 6 the valve operator 212 continues to move from the left to the right and remains within the deadband region between each of the high and low pressure ports 300, 302. The piston 204 decompress the fluid within the cylinder 206 according to movement from near top center toward bottom dead center because the valve operator 212 is in the deadband region. The pressure within the cylinder 206 continues to drop as the piston 204 recovers energy from the compressed fluid otherwise wasted without decompression. As decompression continues within the cylinder 206 the pressure of the fluid therein equalizes to the pressure at the low pressure port 302. The low pressure check valve 902 accordingly opens when the pressure differential between the pressure within the cylinder 206 and the low pressure port 302 exceeds a bias and begins delivering low pressure fluid into the cylinder 206 through the cylinder port 304 as shown in diagram 6

Referring now to diagram 7 of FIG. 9, the valve operator 212 is shown with the main stage valve 210 now open relative to the low pressure port 302. Because of the decompression within the cylinder 206 while the operator 212 was in the deadband region any otherwise remaining energy within the compressed fluid has been harvested by the piston 204. With the valve operator 212 positioned as shown in diagram 7 the low pressure port 302 is in communication with the cylinder 206 for instance through the cylinder port 304 and continued movement of the piston 204 toward bottom dead center fills the cylinder 206 to repeat the pump cycle. Diagram 8 shows the valve operator 212 of the main stage valve 210 in the configuration previously shown in diagram 1 and pre-compression and decompression of fluid within the cylinder 206 are repeated.

FIG. 10 shows a series of 8 diagrams (1-8) with the valve operator 212 of the main stage valve 210 (of an associated cylinder 206 and piston 204) in various positions during movement of the operator 212 in operation of the pump-motor 102 in a motoring configuration. In the diagrams shown in FIG. 10 the valve operator 212 is moved in correspondence to movement of the piston 204 relative to the cylinder 206 in a motoring configuration of the pump-motor 102. For instance the main stage valves 210 and each of the respective cylinders 206 and pistons 204 are operated in correspondence by way of the wobble plate 200 and the pilot spool valve 218 including the pilot spool 220 previously described and shown in FIG. 2. In one example, the pilot spool 220 includes such as the coding 416 previously shown and described herein configured to move the valve operator 212 between the high and low pressure ports 300, 302 shown in FIG. 10 and facilitate operation of the pump-motor 102 in a motoring configuration. Additionally, the coding 416 of the pilot spool 220 is in one example configured to move the main stage valve operator 212 through a deadband region of the main stage valves 210 to accordingly facilitate one or more of pre-compression and decompression during the motoring operation in a manner similar to the pump operation shown in FIG. 9. In a similar manner to FIG. 9, the high and low pressure check valves 900, 902 cooperate with the main stage valve 210 deadband to optimize pre-compression and decompression in the motoring operation as well.

Referring first to diagram 1 of FIG. 10 the valve operator 212 is shown in a configuration that opens the main stage valve 210 and accordingly provides communication between the high pressure port 300 and the cylinder 206 through the cylinder port 304. In the motoring example the piston 204 within the cylinder 206 is travelling downward from top dead center to bottom dead center and adding power to the main shaft 108. The configuration shown in Diagram 1 is maintained until the end of the duty cycle. Transitioning to diagram 2, the valve operator 212 begins the transition through the deadband zone between the high and low pressure ports 300, 302. The cylinder 206 and the piston 204 are accordingly isolated from each of the high and low pressure fluids by way of the valve operator 212. The piston 204 continues in downward motion toward bottom dead center and accordingly begins to decompress the remaining compressed fluid within the cylinder 206. As shown in diagram 3 the valve operator 212 remains within the deadband zone and the cylinder 206 (by way of the cylinder port) remains isolated from the high and low pressure ports 300, 302. The fluid within the cylinder 206 continues to decompress according to movement of the piston 204 toward bottom dead center. In this example energy within the compressed fluid within the cylinder 206 is harvested for a longer time by the piston 204 with decompression provided with the main stage valve operator 212 in the deadband zone (and before opening to the low pressure port 302). Additionally and as shown in diagram 3 as the compressible fluid continues to decompress within the cylinder 206 the low pressure check valve 902 opens thereby allowing for the admission of low pressure fluid to the cylinder 206 (e.g., after reaching a threshold decompression pressure value within the cylinder 206). Similar to the pumping case in FIG. 9, the end of the decompression period coincides with the pressure inside the cylinder 206 falling to a level similar (e.g., the same or the same with some bias) to the low pressure of the fluid at the low pressure port 302. Accordingly, energy harvesting from the compressed fluid is maximized and throttling losses are substantially eliminated. The timing of the completion of decompression is also (like pre-compression during pumping) not sensitive or dependent on the deadband duration as long as the time the valve operator 212 is within the deadband is sufficiently long so that decompression in the cylinder 206 generates a low pressure to trigger opening of the low pressure check valve 902.

At diagram 4 the valve operator 212 is shown in a position to the right relative to that in diagram 3 and accordingly the low pressure port 302 and the low pressure fluid are in communication with the cylinder 206 by way of the cylinder port 304. When the pump-motor is configured as a motor with a duty cycle less than one, the configuration in diagram 4 is maintained from the nominal position of the piston where the power stroke ends to bottom dead center. Low pressure fluid is drawn into the cylinder 206 by way of the cylinder port 304 during the downward portion of the stroke of piston 204. When the piston 204 reaches bottom dead center, the cylinder 206 and the piston 204 are ready to begin exhausting the expanded fluid through the low pressure port 302. The configuration in diagram 4 is maintained for the majority of the upstroke of the piston from bottom dead center to top dead center so that low pressure fluid is readily exhausted from cylinder 206 through cylinder port 304 to low pressure port 302 during the upstroke of piston 204.

Referring now to diagram 5, the main stage valve 212 remains in an open configuration to facilitate the communication between the low pressure port 302 and the cylinder 206 by way of the cylinder port 304 until piston 204 approaches top dead center. In diagram 6 the piston 204 continues to travel upward and approach top dead center and the valve operator 212 begins to move from the right to the left and accordingly enters the deadband zone between the low pressure port 302 and the high pressure port 300 and the cylinder 206 is isolated from each of the high and low pressure ports 300, 302. Accordingly, pre-compression within the cylinder 206 begins as the piston 204 approaches top dead center. Diagram 7 shows continued movement of the valve operator 212 within the deadband region and the cylinder 206 remains isolated from each of the high and low pressure ports 300, 302. Pre-compression continues until the pressure inside the cylinder is substantially similar to the pressure at the high pressure port 300 because of the high pressure check valve 900. As the pressure within the cylinder 206 equalizes with high pressure, the high pressure check valve 900 associated with the main stage valve 210 opens to facilitate the passage of the remaining pressurized fluid from the cylinder 206 to the high pressure port 300. The timing of the ending of pre-compression is not sensitive or dependent on the deadband duration as long as the duration of the deadband is longer than the specified pre-compression time (e.g., based on the specified threshold pressure for the high pressure check valve 900) and the deadband terminates at or before the time that piston 206 reaches top dead center. In one example, optimized system timing corresponds to ending pre-compression at top dead center (e.g., through a specified check valve bias) to minimize back pressure that may otherwise cause a reverse torque (on the piston and accordingly the shaft 108). As shown in diagram 8 as the main stage valve 212 continues to move it transitions out of the deadband zone and accordingly opens the cylinder 206 to the high pressure port 300. Because of the pre-compression provided by the main stage valve 210 (including the valve operator 212) with the deadband region throttling losses otherwise realized because of a pressure differential are minimized (e.g., eliminated or minimized). Accordingly the pump-motor 102 described herein includes further enhancements to efficiency and power output with one or more of pre-compression or decompression.

The extent of the deadband in the main stage valves 210 determines both the timing for initiation of pre-compression before the main stage valves 210 connect respective cylinders 206 with high pressure ports 300 (a first offset), as well as the timing for initiating decompression before the main stage valves 210 connect respective cylinders 206 with low pressure ports 302 (a second offset). In one example, the high and low pressure check valves 900, 902 described and shown in FIGS. 9 and 10 augment the deadbands of main stage valves 210 to help ensure that specified low pressure values are reached during decompression (corresponding to the threshold for the low pressure check valves 902) and specified high pressure values are reached during pre-compression (corresponding to the high pressure check valve 900 threshold). However, in another example, if the check valves 902 or 900 are not included, the deadband for each of the main stage valves provide fixed timing offsets for de-compression or pre-compression that can be optimized for only one specific operating condition determined by one or more specified operating parameters for the pump-motor 102 including, but not limited to, system pressure, fluid compressibility and shaft speed. In this example, when operating parameters vary from the parameters for which the deadband (and optionally the timing shift and backlash) is designed (e.g., for variations of shaft speed, system pressure, or compressibility of the fluid due to air entrainment), fixed timing offsets (based on a specified and constant deadband) are no longer optimal. Furthermore, in another example which includes the check valves 900, 902 illustrated in FIG. 9 and FIG. 10, motoring efficiency is affected by the timing between completing pre-compression and top dead center. This effect is attributable to a reverse torque introduced by pistons 204 on shaft 108 if high pressure is applied to the pistons 204 prior to their reaching top dead center. The ideal timing between pre-compression and top dead center. e.g. the timing which maximizes motoring efficiency, is affected by factors such as fluid compressibility. Furthermore, optimizing deadband length for pre-compression during motoring may adversely affect the deadband length for pumping and de-compression during motoring. Therefore, fixed timing offsets produce optimal timing only if the operating conditions exactly match those assumed during design.

In another example, fully adjustable timing of the deadbands for the main stage valves 210 and the associated pistons 204 and cylinders 206 are realized by way of planetary or differential gear assemblies, as described herein. A planetary or differential gear assembly is used to optimize the motoring operation in the case that check valves 900 and 902 are included, or the pumping operation as well as the motoring operation if either check valves 900 or 902 are not included, by providing a means for varying the timing offsets and hence the initiation of precompression or decompression. In another example, control orifices are included in the pilot connection ducts 216 between the pilot valve 220 and the main stage valves 210. In another example, control orifices are included between the low pressure fluid source 702 and pilot valve 220 or the pilot pressure (greater than low pressure) fluid source and pilot valve 220. As described herein and shown, for instance in FIG. 15, the control orifices change the effective pressure applied by each of the low pressure fluid and the high pressure fluid from the pilot spool 220 to the main stage valves 210 and thereby vary the duration of the deadband (e.g., the time that main stage valve operators remain in the deadband for either or both of pre-compression or decompression).

Figure 11:
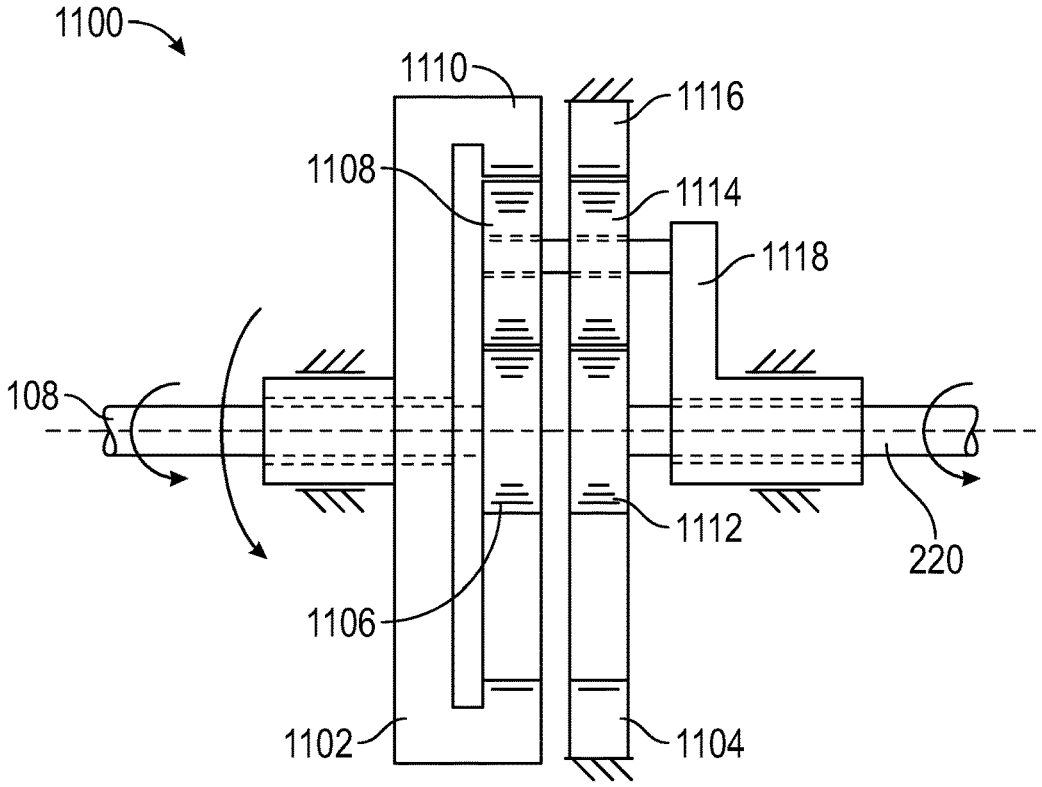
FIG. 11 is a side view of one example of a planetary gear assembly configured to control the initiation of the main stage valve operator deadband.

Implementing variable timing adjustment of the rotary valve spool 220 by way of a planetary gear set is illustrated by example in FIG. 11 with a planetary gear assembly 1100.

Two planetary gear drives 1102, 1104 are cascaded in series. The first consists of sun gear 1106, planet gear 1108 and ring gear 1110. The second consists of sun gear 1112, planet gear 1114 and ring gear 1116. The two planetary gear drives 1102, 1104 share the same arm 1118 to carry the planet gears 1108, 1114, and the planet gears rotate independently relative to each other. Ring gear 1116 is fixed to the pump-motor housing (e.g., the system body 106 shown in FIGS. 1 and 2). The ring gear 1110 is optionally rotated relative to the housing. As shown, the sun and planet gears 1106, 1108, 1112, 1114 have equal diameter, although the gear ratios are optionally varied by changing the diameters. With the configuration shown, when ring gear 1110 is held stationary, the first planetary gear drive 1102 nominally steps up the angular speed of the arm 1118 relative to sun gear 1106 by a ratio of 3:1. The second planetary gear drive 1104 steps down the angular speed of sun gear 1112 relative to the arm 1118 by a ratio of 1:3. If the ring gear 1110 is turned at an angular speed of $\omega_{ring}$, the overall relationship between the main shaft speed 108, $\omega_{shaft}$, and rotary pilot spool 220 speed, $\omega_{pilot}$, is:

$$\omega_{pilot}=\omega_{shaft}+3\omega_{ring}$$

Figure 12:
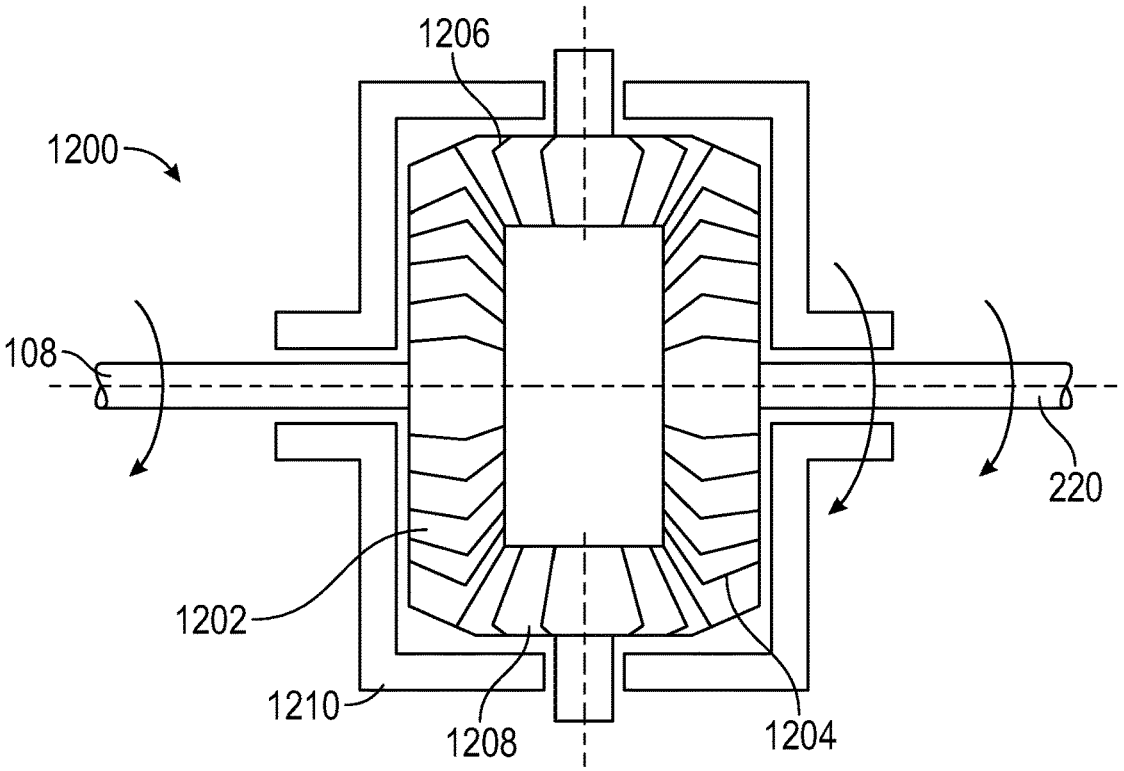
FIG. 12 is a side view of one example of a differential gear assembly configured to control the initiation of the main stage valve operator deadband.

In some examples, the rotatable ring gear 1110 is held stationary. In other examples, the ring gear 1110 is rotated, for example by attaching a stepper motor drive to the ring gear 1110. When rotated, the ring gear 1110 changes the angular position of the rotary pilot spool 220 relative to the angular position of the main shaft 108, thereby varying the timing of when the associated main stage valves 210 enter the deadband region (e.g., isolating the respective cylinders 206 and pistons 204 from high and low pressure fluid ports). The timing is, in one example, varied dynamically while the pump-motor 102 is operating, for instance with changing operating conditions, (e.g., changes in pressure, shaft rotation speed or the like) to control exactly when the connection to high pressure or to low pressure should be made or ended (thereby initiating and ending the deadband) to optimize pre-compression and decompression events An example of implementing variable timing adjustment of the rotary valve spool (e.g., the pilot spool 220) by way of a differential gear set is illustrated in FIG. 12 with the differential gear assembly 1200. Two bevel gears 1202, 1204 rotate about the axis of the main shaft 108. The left bevel gear 1202 is attached to the main shaft 108. The right bevel gear 1204 is attached to the shaft (e.g., the interface shaft 226) that drives the rotary valve spool (pilot spool 220). One or more planet gears 1206 (and optionally 1208) are distributed about the peripheries of the bevel gears 1202, 1204. The planet gears 1206, 1208 are retained in meshing engagement with the bevel gears 1202, 1204 by a planet carrier 1210, and the planet carrier 1210 selectively rotates about the axis of the main shaft 108. If the planet carrier 1210 is turned at an angular speed of $\omega_{carrier}$, the overall relationship between the main shaft speed, $\omega_{shaft}$, and the rotary pilot spool valve speed. $\omega_{pilot}$, is:

$$\omega_{pilot}=-\omega_{shaft}+2\omega_{carrier}$$

If the planet carrier 1210 is held stationary, the differential gear set 1200 reverses the direction of rotation of the rotary valve 220 (e.g., or the interface shaft 226 coupled with the spool) relative to the main shaft 108 while preserving the main shaft speed. In contrast, rotating the planet carrier 1210 changes the angular position of the rotary valve spool 220 relative to the main shaft 108 and varies the timing of when the associated main stage valves 210 enter the deadband region (e.g., isolating the respective cylinders 206 and pistons 204 from high and low pressure fluid ports). Similar to the planetary gear assembly 1100, timing is optionally varied dynamically while the pump-motor is operating, for instance according to changes in the operating conditions. Accommodation is also made for rotation direction reversal between the main shaft and the rotary valve spool 220 in this example (e.g., with the differential gear assembly 1200). This is accomplished by adding a 1:1 external gear set in series with either the main shaft 108 or the pilot spool 220, or adjusting the pilot spool coding and corresponding fluid routing (to the main stage valves 210) to initiate the reversal in direction.

Figure 13A:
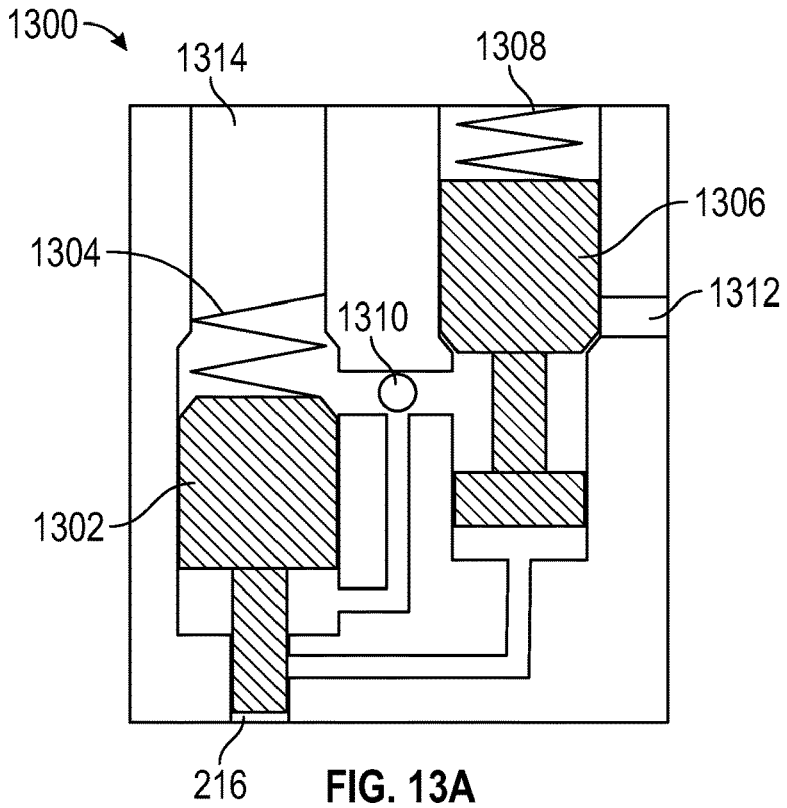
FIG. 13A is a schematic view of another example of a main stage valve including a poppet.
Figure 13B:
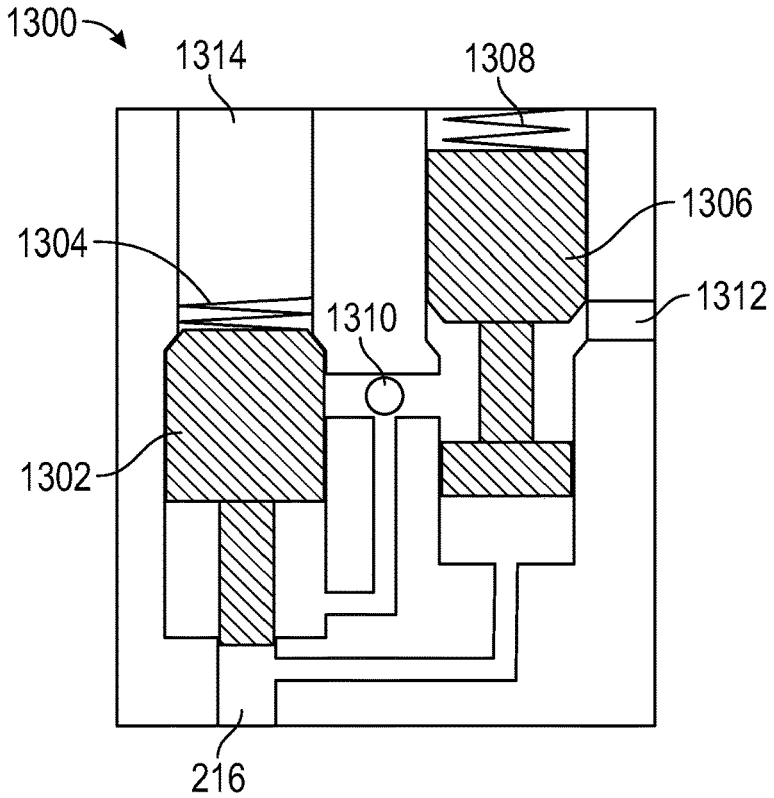
FIG. 13B is a schematic view of the main stage valve shown in FIG. 13A.

FIGS. 13A, B and 14A, B show other examples of main stage valves 1300, 1400 that use poppet valves for better sealing. Referring first to FIGS. 13A, B the main stage valve 1300 is shown in two configurations each opening and closing the associated cylinder in communication with the valve 1300 by way of a cylinder port 1310 (extending into the page). A low pressure configuration is shown in FIG. 13A with the cylinder, such as the cylinder 206, open to a low pressure fluid by way of a low pressure port 1314. FIG. 13B shows a high pressure configuration with the cylinder port 1310 of the cylinder 206 open to the high pressure fluid through a high pressure port 1312.

As shown in FIG. 13A the main stage valve 1300 includes poppets 1302 and 1306. Each of the poppets includes its respective poppet and biasing elements 1304 and 1308. In the configuration shown in FIG. 13A the pilot connection duct 216 communicates a low pressure (tank) fluid by way of the pilot spool valve 218 previously shown in FIG. 2 and described herein. The low pressure fluid at the poppet 1302 facilitates the biasing of the poppet 1302 into the configuration shown by way of the poppet biasing element 1304. Accordingly, low pressure fluid from the low pressure port 1314 is delivered through the cylinder port 1310 to the cylinder 206. As further shown in FIG. 13A the poppet biasing element 1308 biases the second poppet 1306 into the seated configuration shown and accordingly closes the cylinder port 1310 to the high pressure port 1312.

Referring now to FIG. 13B, the example main stage valve 1300 is shown in the high pressure configuration. In this example a high pressure (pilot) fluid (higher pressure than the low pressure fluid) is delivered through the pilot connection duct 216 from the pilot spool valve 218 (FIG. 2) to each of the poppets 1302, 1306. The poppet 1302 is biased upwardly by countering the bias applied by the poppet biasing element 1304. The low pressure port 1314 is thereby closed relative to the cylinder port 1310. Conversely, the high pressure (pilot) fluid delivered through the pilot connection duct 216 also communicates with the portion of the main stage valve 1300 including the second poppet 1306. The poppet 1306 is biased upwardly by countering the bias provided by the poppet biasing element 1308. The poppet 1306 unseats relative the position shown in FIG. 13A and opens the cylinder port 1310 to the high pressure port 1312. The cylinder 206 is thereby opened to the high pressure fluid at the port 1312.

Figure 14A:
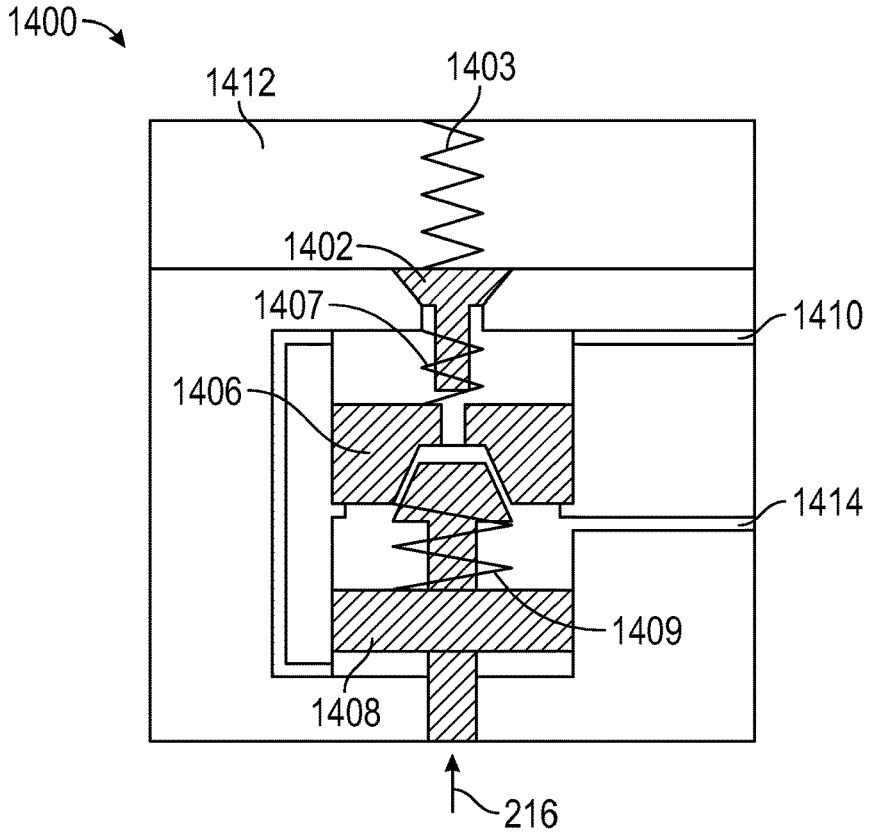
FIG. 14A is a schematic view of still another example of a main stage valve including another poppet.

Referring now to FIGS. 14A, B, another example of a main stage valve 1400 is provided in respective low and high pressure configurations. Referring first to FIG. 14A, the main stage valve 1400 as shown includes a poppet 1402, a middle element 1406 and a bottom element 1408. Each of the poppet 1402, middle element 1406 and the bottom element 1408 are movable relative to the remainder of the main stage valve 1400 and the high and low pressure ports 1412, 1414 as well as the cylinder port 1410 (in communication with a cylinder 206). In the example shown, each of the poppet 1402, the middle element 1406 and the bottom element 1408 are biased into the low pressure configuration shown in FIG. 14A by one or more biasing elements 1403, 1407, 1409. In the low pressure configuration in FIG. 14A low pressure (tank) fluid is delivered by way of the pilot connection duct 216 as previously described herein. The lower pressure (tank) fluid does not overcome the bias provided by each of the biasing elements 1403, 1407, 1409 and accordingly each of the poppet 1402, the middle element 1406 and the bottom element 1408 remain in the configuration shown in FIG. 14A. Accordingly, low pressure fluid provided through the low pressure port 1414 moves between the middle element and bottom element 1406, 1408 and is delivered to the cylinder port 1410.

Figure 14B:
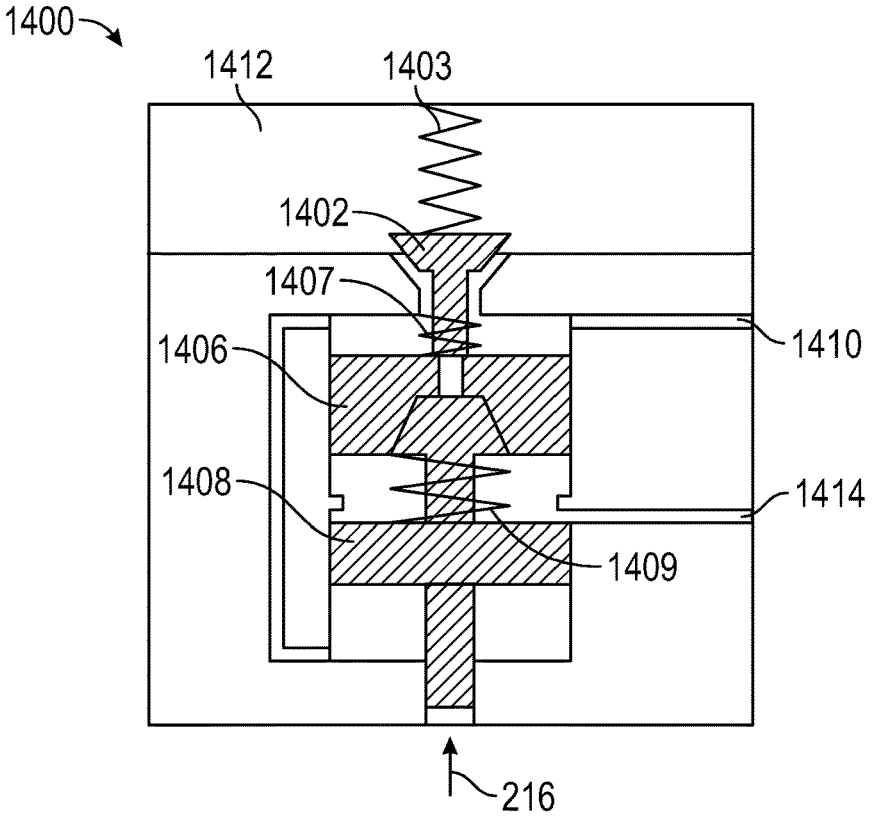
FIG. 14B is a schematic view of the main stage valve shown in FIG. 14A.

Referring now to FIG. 14B, the main stage valve 1400 is shown in a high pressure configuration. In this example the high pressure (pilot) fluid is delivered by the pilot connection duct 216 from the pilot spool valve as described herein. The relatively higher pilot pressure fluid (e.g., in an example less than the high pressure fluid at the high pressure port 300, the pressurized fluid operated on by the pump-motor 102) biases the bottom element 1408 upwardly against the bias provided by the biasing element 1409. The bottom element 1408 moves upwardly and a portion of the bottom element 1408 such as a plug, plunger or the like is seated against a portion of the middle element 1406 and biases the middle element upwardly against the bias provided by the biasing element 1407. The engagement of the bottom element 1408 with the middle element 1406 closes the flow path from the low pressure port 1414 to the cylinder port 1410 of the cylinder 206 associated with the main stage valve 1400. Conversely, the biasing of the middle element 1406 into the position shown in FIG. 14B relative to FIG. 14A biases the poppet 1402 upwardly relative to the bias provided by the biasing element 1403. Movement of the poppet 1402 into the configuration shown in FIG. 14B opens the cylinder port 1410 to the high pressure port 1412 and allows communication between the cylinder 206 and the high pressure fluid (e.g, at the port 1412).

Figure 15:
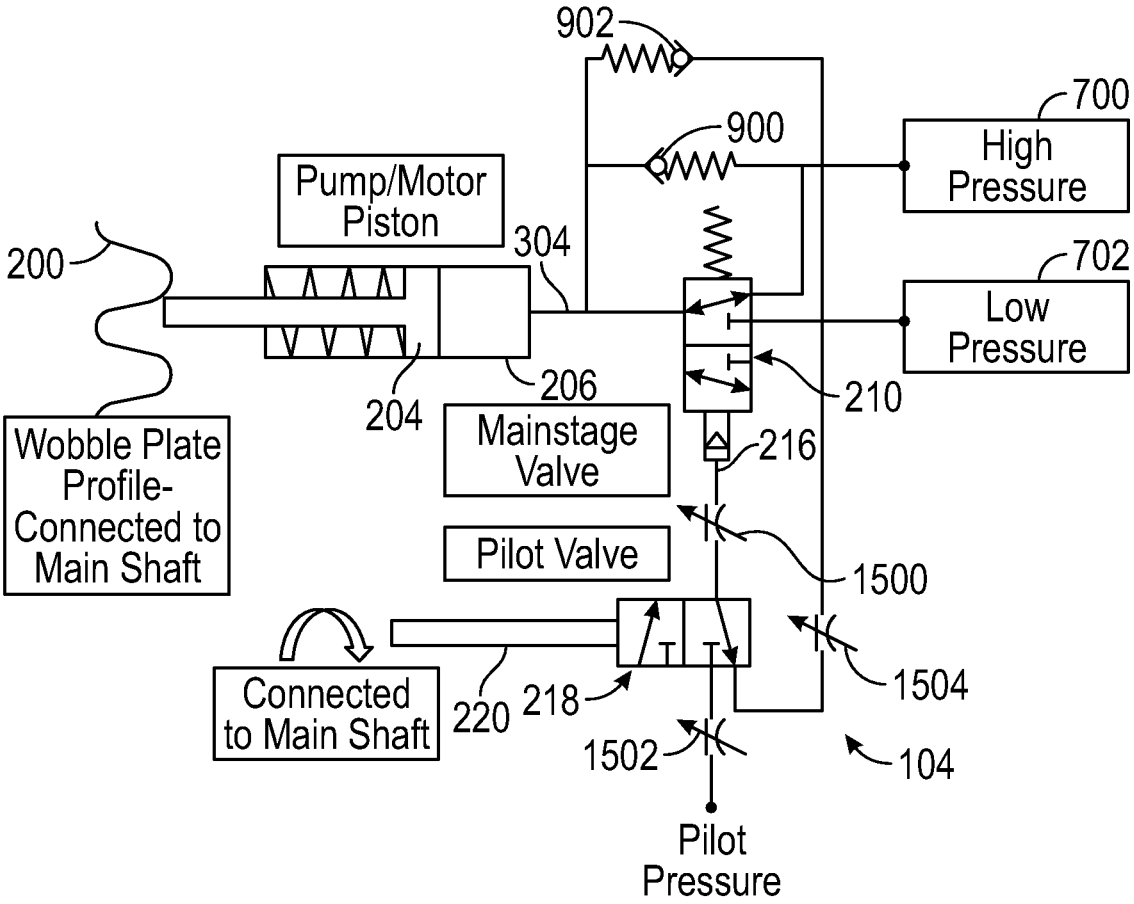
FIG. 15 is a schematic diagram of the system of FIG. 1 with one or more control orifices.

FIG. 15 shows another schematic view of one example of a hydro mechanical control system 104. In contrast to the previous examples described herein the hydro mechanical control system 104 shown in FIG. 15 includes one or more features such as a high pressure check valve 900 (in one example, the same as the check valve 308 in FIG. 3), and a low pressure check valve 902 associated with the cylinder 206, piston 204 and the respective main stage valve 210. The high and low pressure check valves 900, 902 are previously described with regard to the pumping and motoring operations described and shown in FIGS. 9 and 10. The high and low pressure check valves 900, 902 are in one example used for instance with the deadband of the main stage valve 210 to facilitate the pre-compression and decompression with precise timing while optimizing pre-compression and decompression in the cylinder to the respective high and low pressure system fluids at the sources 700, 702 during operation of the piston 204 and the cylinder 206.

Additionally. FIG. 15 shows one or more control orifices 1500, 1502, 1504 provided at varying locations within the hydro mechanical control system 104. As will be described herein the control orifices 1500, 1502, 1504 are in one example operated in combination with the main stage valve 210 to dynamically adjust the deadband duration for the main stage valve 210 (e.g., the length of time that valve operator 212 remains within the deadband). In one example the control orifices 1500, 1502, 1504 are operated to regulate the deadband for the main stage valve 210 beyond the set deadband provided, for instance, by the operator deadband region 800 and the cavity deadband region 802 shown in FIG. 8. Accordingly, instead of having a set deadband, a main stage valve 210 in combination with the one or more control orifices 1500, 1502, 1504 enable the hydro mechanical control system 104 to provide a dynamic range of deadband durations for use with a variety of operating configurations including one or more operating pressures, fluid compressibilities, main shaft speeds or the like.

Referring again to FIG. 15, many of the other features of the hydro mechanical control system 104 shown are similar to the previously discussed schematic views of the hydro mechanical control system 104 provided herein. For instance, each of the respective main stage valves 210, one of which is shown in FIG. 15, is associated with one of the cylinders 206 and pistons 204 of the pump-motor 102 described herein. Additionally, in one example the pistons 204 of each of the piston and cylinder assemblies are optionally coupled with a wobble plate, such as the wobble plate 200 (although other pump or motor mechanisms including, but not limited to, radial piston, mechanical linkages such as crankshafts, variable displacement mechanisms such as swash plates or the like could alternately be used).

As further shown in FIG. 15, the pilot spool valve 218, including the pilot spool 220, is in communication with the main stage valve 210 and is operated to accordingly transition the main stage valve 210 from a configuration connecting the high pressure fluid source 700 with the cylinder 206 and alternatively closing the cylinder 206 to the high pressure fluid source 700 and opening the cylinder 206 to the low pressure fluid source 702. In one example, the application of high pressure (pilot) fluid for instance by way of coding on the pilot spool 220 to the main stage valve 210 biases the valve operator 212 into a configuration closing the cylinder 206 with respect to the high pressure source 700 (e.g., for instance a source of high pressure fluid the same as or different from the high pressure fluid used by the pilot spool 222). Conversely the application of a tank pressure fluid (e.g., a lower pressure than the pilot pressure) by way of the coding of the pilot spool 220 to the main stage valve 210 biases the valve operator 212 (as shown in FIG. 3B) into an open position relative to the high pressure fluid source 700.

In the example shown in FIG. 15 and as previously described in one example the hydro mechanical control system 104 includes at least one control orifice such as the control orifice 1500. In one example the control orifice 1500 provided between the pilot spool valve 218 and the main stage valve 210 controls the flow through the pilot connection duct 216 to the main stage valve 210. By throttling the flow of pilot pressure fluid and low (tank) pressure fluid through the pilot connection duct 216 to the main stage valve 210 the deadband (e.g., the length of time of that main stage spool operator 212 remains in the deadband region) for the main stage valve 210 is controlled (e.g., including one or more of regulated, decreased, increased, maintained or the like) according to the operation of the control orifice 1500. For instance, in one example where the control orifice 1500 is fully open the flow of either high pressure (pilot) fluid or low pressure (tank) fluid to the main stage valve 210 is at a relatively high flow rate and accordingly the valve operator 212 transitions quickly (e.g., near immediately) between opening of the cylinder 206 to the high and low pressure fluid sources 700, 702. While the control orifice 1500 is fully open the main stage valve deadband corresponds to the normal operating deadband for the valve (e.g., based on dimensions of the operator 212). Conversely, with throttling of the control orifice 1500 (e.g., decreasing the flow of either of the high or low pressure fluids) the time that the main stage spool operator 212 remains in the deadband region for the main stage valve 210 is increased. The regulated, lower flow rates of the fluids applied to the valve operator 212 cause the operator 212 to transition more slowly between the high and low pressure fluid sources 700, 702 and accordingly the deadband is increased. Pre-compression and decompression provided by the main stage valve 210 in combination with the cylinder 206 and the piston 204 are correspondingly increased (e.g., lengthened relative to the stroke of the piston 204). By increasing the time that the main stage spool operator 212 remains in the deadband region sufficiently, the high pressure and low pressure check valves 900, 902 are used to control the end of pre-compression and decompression as explained herein and shown by example in FIGS. 9 and 10.

In another example and as shown in FIG. 15, one or more control orifices 1502, 1504 are optionally provided between the source of the high pressure fluid and the low pressure fluid relative to the pilot spool valve 218. In this example independent control orifices 1502, 1504 are used to regulate the flow of high and low pressure fluids to the pilot spool valve 218 and correspondingly to the main stage valve 210 to accordingly control the time that the main stage spool operator 212 remains in the deadband of the main stage valve 210 and the corresponding pre-compression and decompression with the cylinder 206 and the piston 204.

With the control orifices 1502, 1504, in one example the reservoir for the pilot pressure fluid and the reservoir for the low pressure fluid each need a single control orifice 1502, 1504 to provide the flow of fluids to the pilot spool valve. The high pressure and low pressure fluids are then distributed to each of the main stage valves 210 as described herein.

In the converse configuration, for instance with the control orifice 1500 positioned in the pilot connection duct 216 for each of the main stage valves 210 for each of the cylinders 206 (in the example provided in FIGS. 1 and 2 there are eight cylinders) requires its own dedicated control orifice 1500. In this arrangement the duplicated control orifices 1500 for each of the main stage valves 210 provides dedicated individual control of the time that the main stage spool operator 212 remains in the deadband region for each of the main stage valves 210. In contrast, the previously discussed configuration with the control orifices 1502 and 1504 requires two control orifices 1502, 1504 that are provided upstream relative to the pilot spool valve 218.

Although the above described hydromechanical control system 104 is shown with each of high and low pressure fluid sources 700, 702, in another example, the system 104 includes one of the fluid sources, for instance the low pressure fluid source 702. In this example, the hydromechanical control system 104 and the associated pump-motor are operated as a pump e.g., as opposed to a motor. In this example, the pilot spool valve 218 including the pilot spool 220 optionally includes coding 416 for control of the main stage valves 210 in a pumping configuration (e.g., regions 412A, 412B shown in FIGS. 5 and 6). Further, the main stage valves (shown in FIG. 15 by the representative main stage valve 210) in this example include a low pressure port (in communication with the low pressure fluid source 702) and are coupled with the pilot connection duct 216. Stated another way, the two way selective connection with the low pressure fluid and the high pressure fluid is not used.

The above detailed description includes references to the accompanying drawings, which form a part of the detailed description. The drawings show, by way of illustration, specific embodiments in which the disclosure can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B." "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the disclosure should be determined with reference to the appended claims, along with the full scope of equivalents to which such claims are entitled.

The claimed invention is:

1. A variable displacement pump-motor system comprising:

a pump-motor including a plurality of cylinders and a plurality of pistons slidably received in the cylinders, the pump-motor includes:

a system body including the plurality of cylinders, and a main shaft rotatable relative to the system body;

a hydromechanical fluid control system comprising:

a plurality of main stage valves in communication with the plurality of cylinders, respectively, each of the main stage valves is configured to open and close a respective cylinder of the plurality of cylinders to one or more of a high pressure fluid source or a low pressure fluid source, a pilot spool valve in selective communication with each of the main stage valves with respective pilot connection ducts, the pilot spool valve includes a pilot spool configured for rotation and translation within the system body, and the pilot spool rotates with the main shaft, and wherein the pilot spool includes coding configured to operate each of the main stage valves to open and close the respective cylinders to one or more of the high pressure fluid source or the low pressure fluid source according to a translational position of the pilot spool and rotation of the pilot spool by the main shaft.

2. The pump-motor system of claim 1, wherein the coding of the pilot spool includes:

a low pressure region, and as one or more of the main stage valves are in communication with the low pressure region the respective cylinders are opened to the high pressure fluid source and closed to the low pressure fluid source, and a pilot pressure region, and as the one or more of the main stage valves are in communication with the pilot pressure region the respective cylinders are closed to the high pressure fluid source and opened to the low pressure fluid source.

3. The pump-motor system of claim 2, wherein at least the low pressure region includes a tapered profile, and the tapered profile opens the respective cylinders to the high pressure fluid source for a specified period based on the translational position of the pilot spool and the tapered profile relative to the pilot connection ducts.

4. The pump-motor system of claim 2, wherein at least the high pressure region includes a tapered profile, and the tapered profile opens the respective cylinders to the low pressure fluid source for a specified period based on the translational position of the pilot spool and the tapered profile relative to the pilot connection ducts.

5. The pump-motor system of claim 2, wherein the low pressure region of the pilot spool includes a pump low pressure region and a motor low pressure region, and the pilot pressure region of the pilot spool includes a pump pilot pressure region and a motor pilot pressure region.

6. The pump-motor system of claim 5, wherein the pump low pressure region of the pilot spool corresponds to a variable portion of piston movement of the plurality of pistons between bottom dead center to top dead center.

7. The pump-motor system of claim 5, wherein the motor low pressure region of the pilot spool corresponds to a variable portion of piston movement of the plurality of pistons between top dead center to bottom dead center.

8. The pump-motor system of claim 1, wherein the pilot spool includes a pump region and a motor region, the pump region corresponds to a first translational location range of the pilot spool relative to the pilot connection ducts, and the motor region corresponds to a second translation location range of the pilot spool relative to the pilot connection ducts.

9. The pump-motor system of claim 1, wherein the main shaft is coupled with the pilot spool by an interface shaft, and the pilot spool is translationally slidable along the interface shaft and rotationally locked relative to the interface shaft.

10. The pump-motor system of claim 1, wherein each of the main stage valves includes a low pressure port, a high pressure port and a cylinder port, the cylinder port in communication with the respective cylinder.

11. The pump-motor system of claim 10, wherein each main stage valve includes a valve operator, the valve operator of each main stage valve is biased into a first position to open the respective cylinder to the high pressure fluid source with application of tank pressure fluid from the pilot spool to the valve operator, and the valve operator of each main stage valve is biased into a second position to close the respective cylinder to the high pressure fluid source with application of pilot pressure fluid from the pilot spool to the valve operator, the pilot pressure fluid is at a greater pressure than the tank pressure fluid.

12. The pump-motor system of claim 10, wherein each main stage valve includes a valve operator, the valve operator of each main stage valve is biased into a first position to close the respective cylinder to the high pressure fluid source with application of tank pressure fluid from the pilot spool to the valve operator, and the valve operator of each main stage valve is biased into a second position to open the respective cylinder to the high pressure fluid source with application of pilot pressure fluid from the pilot spool to the valve operator, the pilot pressure fluid is at a greater pressure than the tank pressure fluid.

13. The pump-motor system of claim 10, wherein the high pressure port includes a high pressure check valve, and the high pressure check valve is configured to open the high pressure fluid source to an associated cylinder as a threshold high pressure is reached with pre-compression in the associated cylinder of the plurality of cylinders, and wherein the low pressure port includes a low pressure check valve, and the low pressure check valve is configured to open the cylinder to the low pressure fluid source as a threshold low pressure is reached with decompression in the associated cylinder of the plurality of cylinders.

14. The pump-motor system of claim 13, wherein each of the main stage valves includes a deadband between openimg of the associated cylinder to the high pressure fluid source and the low pressure fluid source, and pre-compression and decompression within the associated cylinder are within the deadband.

15. The pump-motor system of claim 1, wherein each main stage valve includes a valve operator, the valve operator includes a deadband region, the deadband region is between first and second positions where the respective cylinder is open to the high pressure fluid source and the low pressure fluid source, respectively, in the deadband region the respective cylinder is disconnected from both the high and low pressure fluid sources, and the valve operator is configured to reside in the deadband region for a specified tune while transitioning between the first and second positions.

16. The pump-motor system of claim 15 comprising at least one control orifice in communication with at least one of the main stage valves of the plurality of main stage valves, wherein the at least one control orifice is configured to control a flow of tank pressure fluid and pilot pressure fluid to the at least one main stage valve, the tank and pilot pressure fluids actuate the valve operator, and wherein the at least one control orifice is configured to control the specified time of the deadband region according to the controlled flow of tank and pilot pressure fluids.

17. The pump-motor system of claim 1, wherein the pilot spool includes a backlash configured to control the valve operator including the timing of disconnection of the respective cylinder from the high and low pressure fluid sources.

18. The pump-motor system of claim 17, wherein the backlash includes a shift in a portion of the coding of the pilot spool relative to one or more of a top dead center or a bottom dead center of the respective cylinder.

19. The pump-motor system 18, wherein the backlash includes a specified quantity of relative rotation between the pilot spool and the main shaft.

20. The pump-motor system of claim 1 comprising a planetary gear assembly interposed between the main shaft and the pilot spool valve, wherein the planetary gear assembly is configured to adjust a valve timing of the main stage valves relative to movement of the plurality of pistons within the plurality of cylinders.

21. A method for hydro-mechanically controlling a pump-motor system comprising:

controlling opening and closing of one or more cylinders to a high pressure fluid source with a pilot spool valve, controlling including:

longitudinally positioning a pilot spool of the pilot spool valve relative to one or more pilot connection ducts, and rotating coding of the pilot spool relative to the one or more pilot connection ducts;

regulating a duty cycle of the one or more cylinders according to the controlled opening and closing of the one or more cylinders, regulating including one or more of:

increasing a high pressure portion of piston strokes within the one or more cylinders according to the longitudinal position and coding of the pilot spool, or decreasing the high pressure portion of piston strokes within the one or more cylinders according to the longitudinal position and coding of the pilot spool.

22. The method of claim 21 comprising maintaining a constant piston stroke travel while regulating the duty cycle of the one or more cylinders.

23. The method of claim 21, wherein the coding of the pilot spool includes a high pressure region and a low pressure region, and controlling opening and closing of the one or more cylinders includes:

rotating the low pressure region across the one or more pilot connection ducts to open the one or more cylinders to the high pressure fluid source, and rotating the high pressure region across the one or more pilot connection ducts to close the one or more cylinders to the high pressure fluid source.

24. The method of claim 23, wherein the coding of the pilot spool includes a tapered profile between the high and low pressure regions, and regulating the duty cycle includes one of increasing or decreasing the high pressure portion of piston strokes according to the tapered profile and the high and low pressure regions.

25. The method of claim 21, wherein regulating the duty cycle of the one or more cylinders includes operating one or more main stage valves associated with respective cylinders of the one or more cylinders according to:

the longitudinally positioning of the pilot spool of the pilot spool valve relative to the one or more pilot connection ducts, and the rotating of the coding of the pilot spool relative to the one or more pilot connection ducts.

26. The method of claim 21, wherein the pump-motor system is configured for pumping and in a pumping configuration:

increasing the high pressure portion of piston strokes within the one or more cylinders increases a pump flow rate, and decreasing the high pressure portion of piston strokes within the one or more cylinders decreases the pump flow rate.

27. The method of claim 21, wherein the pump-motor system is configured for motoring and in a motoring configuration:

increasing the high pressure portion of piston strokes within the one or more cylinders increases power, and decreasing the high pressure portion of piston strokes within the one or more cylinders decreases power.

* * * * *